US011374367B2

(12) United States Patent
Johnson et al.

(10) Patent No.: US 11,374,367 B2
(45) Date of Patent: Jun. 28, 2022

(54) VIBRATING CONNECTOR SYSTEM

(71) Applicant: Onanon, Inc., Milpitas, CA (US)

(72) Inventors: Dennis J. Johnson, Milpitas, CA (US); Keyon Keshtgar, Milpitas, CA (US)

(73) Assignee: Onanon, Inc., Milpitas, CA (US)

( * ) Notice: Subject to any disclaimer, the term of this patent is extended or adjusted under 35 U.S.C. 154(b) by 9 days.

(21) Appl. No.: 17/036,067

(22) Filed: Sep. 29, 2020

(65) Prior Publication Data

US 2022/0102920 A1 Mar. 31, 2022

(51) Int. Cl.

| | |
|---|---|
| ***H01R 13/66*** | (2006.01) |
| ***G08B 6/00*** | (2006.01) |
| ***H01R 13/62*** | (2006.01) |
| ***H01R 13/631*** | (2006.01) |

(52) U.S. Cl.

CPC ..... *H01R 13/6691* (2013.01); *G08B 6/00* (2013.01); *H01R 13/6205* (2013.01); *H01R 13/631* (2013.01)

(58) Field of Classification Search

CPC ..... H01R 13/6691; H01R 13/6205; H01R 13/631; G08B 6/00

USPC ..... 439/39

See application file for complete search history.

(56) References Cited

U.S. PATENT DOCUMENTS 3,808,577 A * 4/1974 Mathauser ..... H01R 13/6205 439/39
3,810,258 A * 5/1974 Mathauser ..... H01R 13/6205 439/39
3,816,679 A * 6/1974 Hotchkiss ..... H01R 13/7037 200/51.09
4,544,903 A * 10/1985 Grant ..... H01H 36/0073 335/205
4,874,316 A 10/1989 Kamon
5,015,061 A * 5/1991 Giannini ..... G02B 6/3817 385/56
5,167,522 A 12/1992 Behning
5,401,175 A 3/1995 Guimond
6,623,276 B2 * 9/2003 Dalmau ..... H01R 13/6205 335/205
7,311,526 B2 12/2007 Rohrbach
8,348,678 B2 1/2013 Hardisty
8,602,795 B2 * 12/2013 Hsu ..... H01R 13/6205 439/39
8,951,248 B2 * 2/2015 Messerly ..... A61B 18/1233 606/34
9,083,110 B2 * 7/2015 McClelland ..... H01R 13/6205
9,225,126 B2 * 12/2015 Janfada ..... H01R 13/629
9,431,182 B2 * 8/2016 Kim ..... H01R 13/7038
(Continued)

*Primary Examiner* — Alexander Gilman
(74) *Attorney, Agent, or Firm* — Neustel Law Offices

(57) ABSTRACT

A vibrating connector system for providing a haptic feedback to ensure that a connector has a proper connection with its mating component or connector. The vibrating connector system generally includes a first connector that is adapted to electrically connect with a second connector. The first connector may include a male coupler and at least one electrical connector such as an electrically conductive pin. The second connector may include a female coupler and at least one electrical receiver such as an electrically conductive socket. A vibrating element may be connected to the first connector and/or the second connector so as to provide a haptic feedback response upon an electrical connection being completed between the first and second connectors.

17 Claims, 17 Drawing Sheets

(56) References Cited

U.S. PATENT DOCUMENTS

| | | | | |
|---|---|---|---|---|
| 9,531,118 | B2 * | 12/2016 | Byrne | H01R 13/6205 |
| 9,985,384 | B1 * | 5/2018 | Johnson | H01R 13/73 |
| 10,381,782 | B2 * | 8/2019 | Byrne | H01R 13/6205 |
| 10,454,208 | B2 | 10/2019 | Johnson | |
| 2017/0102424 | A1 * | 4/2017 | Maalouf | H01R 13/502 |
| 2017/0110827 | A1 * | 4/2017 | Finona | H01R 11/30 |
| 2017/0125949 | A1 * | 5/2017 | Saur | H01R 13/64 |
| 2017/0194739 | A1 * | 7/2017 | Park | H01R 13/6675 |
| 2018/0358749 | A1 * | 12/2018 | Byrne | H01R 13/641 |
| 2019/0115691 | A1 * | 4/2019 | Johnson | H01R 13/582 |
| 2020/0052437 | A1 | 2/2020 | Johnson | |
| 2020/0146361 | A1 * | 5/2020 | Silver | A61M 11/042 |
| 2021/0219608 | A1 * | 7/2021 | Carlberg | A61M 15/06 |

* cited by examiner

VIBRATING CONNECTOR SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a vibrating connector system for providing a haptic feedback to ensure that a connector has a proper connection with its mating component.

Related Art

Any discussion of the related art throughout the specification should in no way be considered as an admission that such related art is widely known or forms part of common general knowledge in the field.

Electrical connectors are commonly used for connecting power, data, and/or other electrical signals between two different components. Such electrical connectors have become ubiquitous with modern life. Common electrical connectors used daily by billions of people include power charging cables for smart phones. Typically, a male coupler which includes male electrical connectors is electrically connected to a female coupler which includes female electrical connectors. When the male electrical connectors are adequately engaged with corresponding female electrical connectors, an electrical connection is made between the first and second connectors.

In modern times, it is increasingly important to ensure that a proper connection has been made when using such electrical connectors. For example, someone going to bed for the evening who plugs in his/her smart phone to charge will be in for a rude awakening in the morning if a proper electrical connection was not made. As another example, certain diagnostics software programs may improperly function if a partial or incomplete connection is made.

In light of the consequences of incomplete connections, it is increasingly important that a user have peace of mind that, after connecting a pair of connectors, an adequate electrical connection has been made. In the past, lights have been used to indicate when a connection has been made. For example, various electrical devices include an indicator light that will illuminate only when such devices are plugged in and charging. However, such indicator lights can be easy-to-miss or even easier-to-ignore after years of routinely making a connection and walking away. It would thus be far more beneficial if the connectors could provide some type of haptic feedback response that will not be so easily ignored or disregarded, even with years of repeat use.

SUMMARY

An example embodiment is directed to a vibrating connector system. The vibrating connector system includes A vibrating connector system for providing a haptic feedback to ensure that a connector has a proper connection with its mating component or connector. The vibrating connector system generally includes a first connector that is adapted to electrically connect with a second connector. The first connector may include a male coupler and at least one electrical connector such as an electrically conductive pin. The second connector may include a female coupler and at least one electrical receiver such as an electrically conductive socket. A vibrating element may be connected to the first connector and/or the second connector so as to provide a haptic feedback response upon an electrical connection being completed between the first and second connectors.

There has thus been outlined, rather broadly, some of the embodiments of the vibrating connector system in order that the detailed description thereof may be better understood, and in order that the present contribution to the art may be better appreciated. There are additional embodiments of the vibrating connector system that will be described hereinafter and that will form the subject matter of the claims appended hereto. In this respect, before explaining at least one embodiment of the vibrating connector system in detail, it is to be understood that the vibrating connector system is not limited in its application to the details of construction or to the arrangements of the components set forth in the following description or illustrated in the drawings. The vibrating connector system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
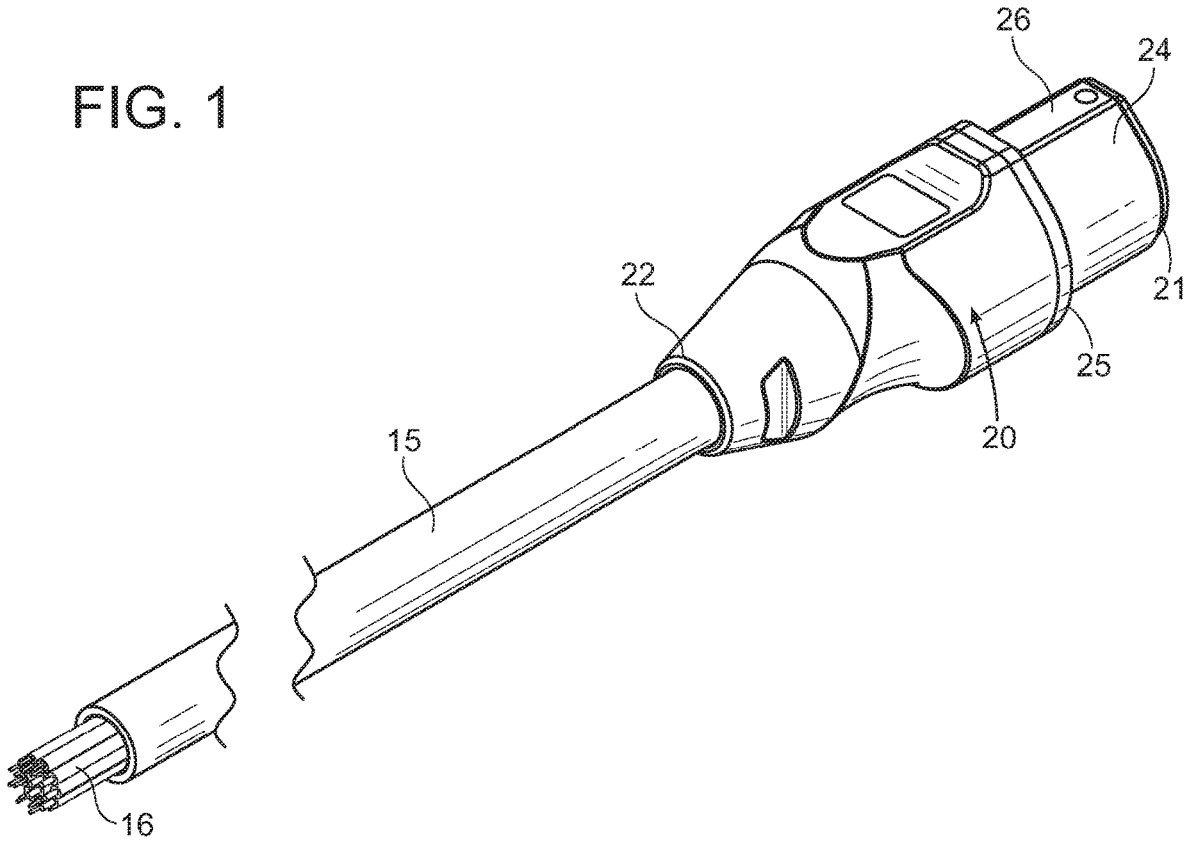
FIG. 1 is a first perspective view of a first connector of a vibrating connector system in accordance with an example embodiment.

A. Overview.

An example vibrating connector system 10 generally comprises a first connector 20 comprising a front end 21 and a rear end 21, wherein the first connector 20 comprises a plurality of first electrically conductive elements 35, 65 at or near the front end 21 of the first connector 20; an electrical conduit 17 connected to the first connector 20; a second connector 50 comprising a front end 51 and a rear end 52, wherein the second connector 50 comprises a plurality of second electrically conductive elements 35, 65 at or near the front end of the second connector 50; wherein the first and second connectors 20, 50 are adapted to be coupled together such that the plurality of first electrically conductive elements 35, 65 of the first connector 20 electrically connect to the plurality of second electrically conductive elements 35, 65 of the second connector 50; and a vibrating element 40 connected between the electrical conduit 17 and the plurality of first electrically conductive elements 35, 65 of the first connector 20 such that an electrical current is applied to the vibrating element 40 when the plurality of first electrically conductive elements 35, 65 of the first connector 20 are electrically connected to the plurality of second electrically conductive elements 35, 65 of the second connector 50, wherein the vibrating element 40 is adapted to vibrate when the plurality of first electrically conductive elements 35, 65 of the first connector 20 are electrically connected to the plurality of second electrically conductive elements 35, 65 of the second connector 50.

The plurality of first electrically conductive elements 35, 65 and the plurality of second electrically conductive elements 35, 65 may be comprised of pins or sockets. In a first exemplary embodiment, the plurality of first electrically conductive elements 35, 65 are comprised of sockets and the plurality of second electrically conductive elements 35, 65 are comprised of pins. In a second exemplary embodiment, the plurality of first electrically conductive elements 35, 65 are comprised of pins and the plurality of second electrically conductive elements 35, 65 are comprised of sockets.

The vibrating element 40 may be comprised of an eccentric rotating mass vibration motor such as a rotating disk motor. The vibrating element 40 may be comprised of a linear resonant actuator. The vibrating element 40 may be directly connected to at least one of the plurality of first electrically conductive elements 35, 65. The vibrating element 40 may be directly connected to the electrical conduit 17.

The first connector 20 may be connected to a cable 15 and the second connector may be connected to a component 18 such as an electrical device. The first connector 20 may be connected to a cable 15 and the second connector 50 may be connected to a wall. The first connector 20 may comprise a housing 23, wherein the vibrating element 40 is positioned within the housing 23 of the first connector 20. The housing 23 of the first connector 20 may comprise a recessed opening 27, wherein the plurality of first electrically conductive elements 35, 65 is positioned within the recessed opening 27, wherein the plurality of first electrically conductive elements 35, 65 is oriented towards the front end 21 of the first connector 20.

The first connector 20 may be comprised of a male coupler 24 and the second connector 50 may be comprised of a female coupler 54. The first connector 20 may be comprised of a female coupler 54 and the second connector 50 may be comprised of a male coupler 24.

A control unit 36 may be operatively connected to the vibrating element 40. The vibrating element 40 may be adapted to vibrate for a preset duration when the first connector 20 is electrically connected to the second connector 50. The vibrating element 40 may be adapted to pulse when the first connector 20 is electrically connected to the second connector 50. The first connector 20 may comprise a first magnetic latching element 38 and the second connector 50 may comprise a second magnetic latching element 68, wherein the first magnetic latching element 38 is adapted to magnetically engage with the second magnetic latching element 68 when the first connector 20 is connected to the second connector 50.

B. Connectors.

The figures illustrate exemplary embodiments of a vibrating connector system 10 in which a vibrating element 40 is adapted to provide a haptic, vibrating response when a first connector 20 is electrically connected to a second connector 50. In the exemplary embodiment shown in FIGS. 1-4, 5, and 6, a first connector 20 comprising a male coupler 24 is shown connected to a distal end 16 of a cable 15. In such an embodiment, the cable 15 may comprise one or more electrical wires 17 or conduits within an insulating outer material.

Figure 7:
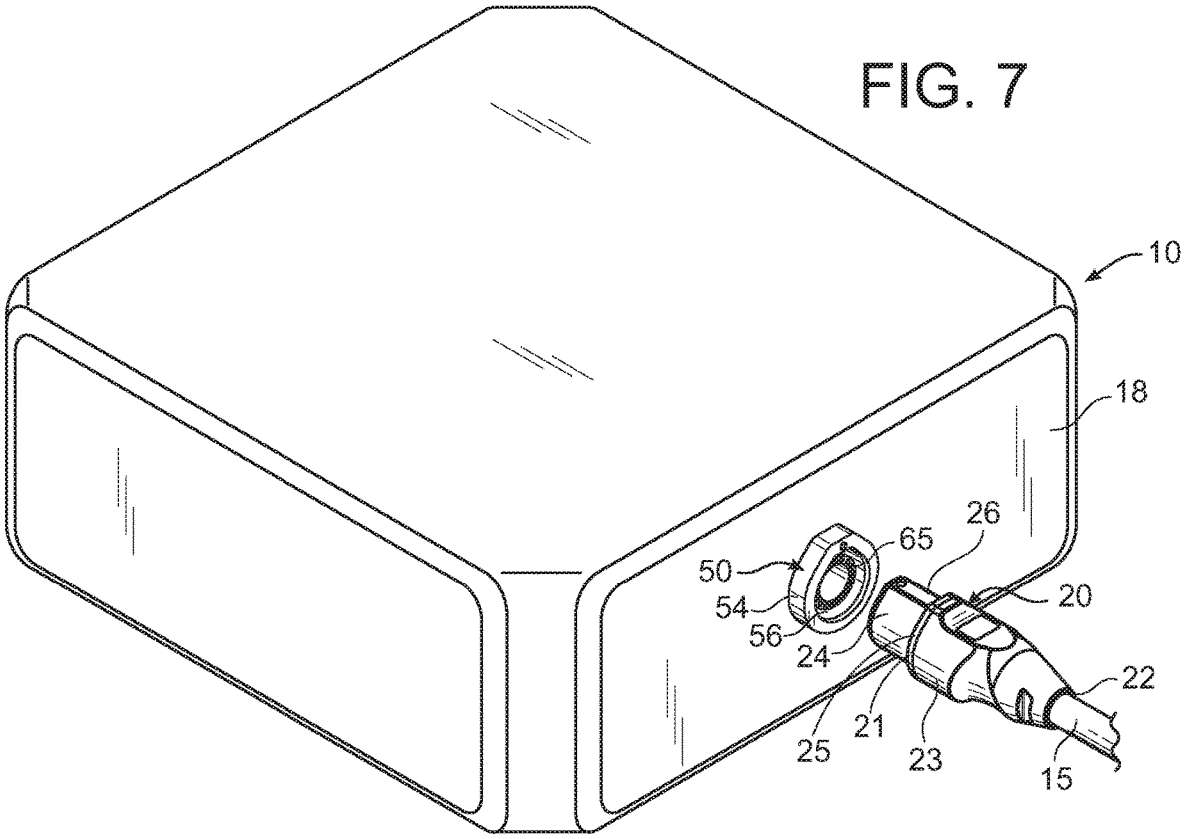
FIG. 7 is a perspective view illustrating a first connector aligned for connection to a second connector comprised of a panel mount connector of a vibrating connector system in accordance with an example embodiment.
Figure 8:
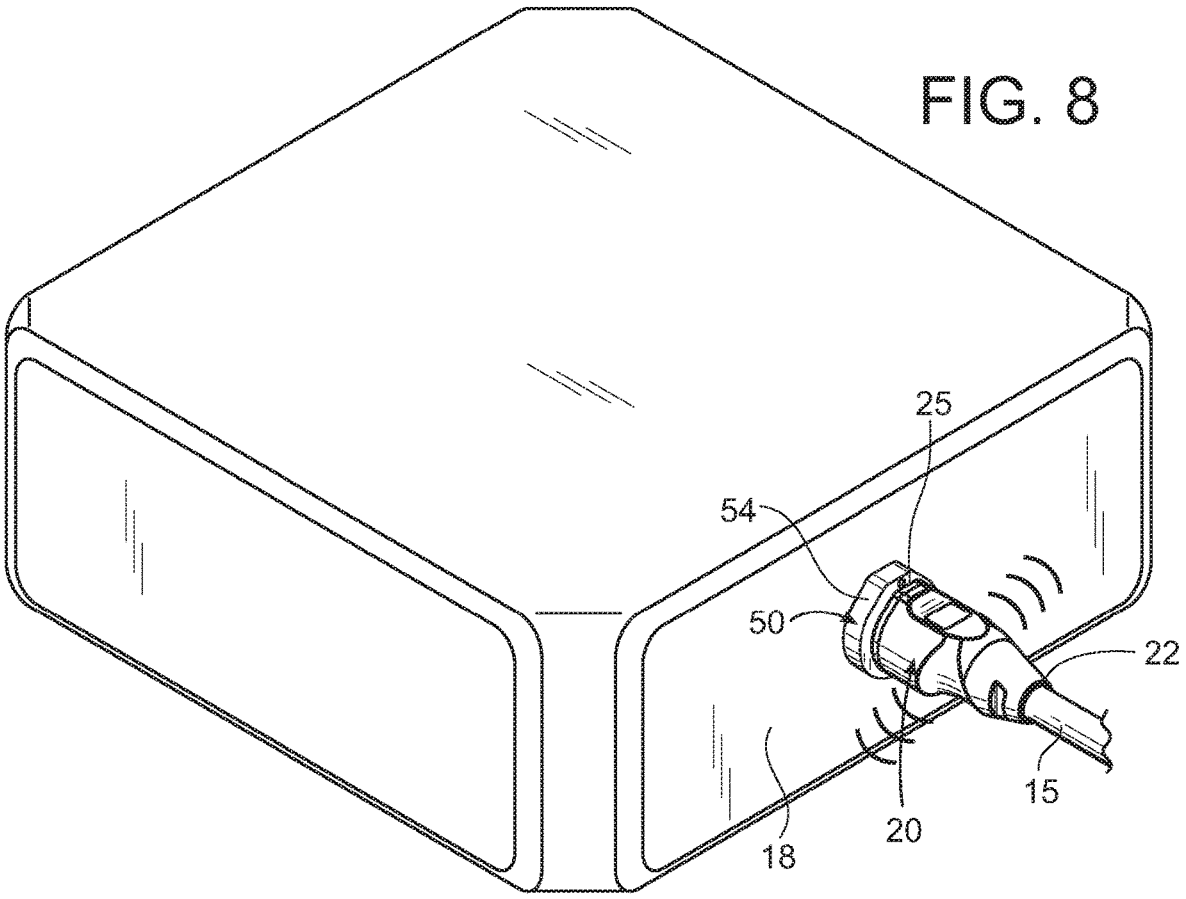
FIG. 8 is a perspective view illustrating a first connector connected to a second connector comprised of a panel mount connector and providing a haptic feedback response of a vibrating connector system in accordance with an example embodiment.
Figure 13:
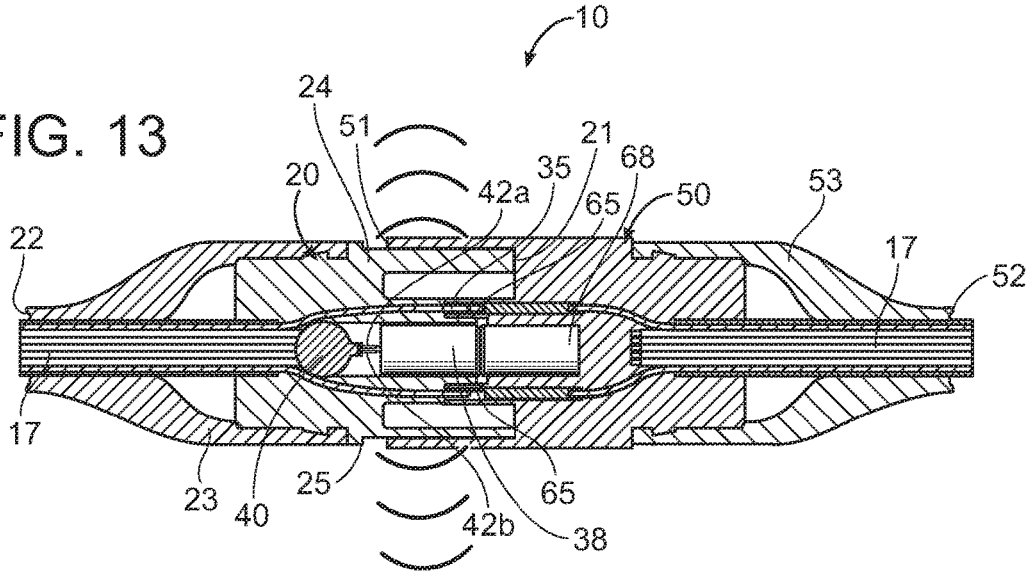
FIG. 13 is a side sectional view of a first connector connected to a second connector comprised of an in-line connector and providing a haptic feedback response of a vibrating connector system in accordance with an example embodiment.

The first connector 20 may be utilized to electrically connect with a corresponding second connector 50 such as shown in FIGS. 7 and 8. The second connector 50 may comprise a female coupler 54 which is adapted to receive the male coupler 24 so as to complete an electrical connection between the first and second connectors 20, 50. In the exemplary embodiments shown in FIG. 7, the first connector 20 is shown at the distal end 16 of a cable 15 and the second connector 50 is shown as being connected to a structure such as a wall or component 18. In other embodiments such as shown in FIG. 13, the first and second connectors 20, 50 may each be connected to a respective distal end 16 of a pair of cables 15.

It should be appreciated that the configuration of the first and second connectors 20, 50 may vary in different embodiments. In some embodiments, the first connector 20 comprising a male coupler 24 may be connected to a component 18 or other structure, with the second connector 50 comprising a female coupler 54 being connected to a cable 15.

Various types of components 18 known to utilize electrical connectors 20, 50 may be utilized, such as but not limited to wall sockets, computer systems, tablet computers, peripheral accessories such as printers, scanners, and the like, monitors, medical devices, power connectors, mobile phones, and the like may be utilized in connection with the vibrating connector system 10. By way of example, an exemplary embodiment could include a first connector 20 comprising a universal serial bus (USB) male connector and the second connector 50 comprising a USB female port of a mobile device such as a smart phone, tablet, watch, camera, or the like.

The vibrating connector system 10 may be utilized with a wide range of cables 15, such as electrical cables adapted to transmit power and/or signals to a device or another cable 15. It should be appreciated that any cables 15 utilized with one or both connectors 20, 50 of the vibrating connector system 10 may be used in a variety of manners. Cables 15 may be utilized to connect two devices such as pieces of equipment together, to connect to another cable 15, or to connect a power source with a device such as a mobile phone for charging or data transfer.

By way of example, the opposite end of any such cables 15 may be connected to a source of electrical power and/or signals, a piece of equipment or a device that receives electrical power and/or signals, another connector adapted to be connected to yet another cable 15, source, or piece of equipment, or to an intermediate device, such as a switch or multiplexor. In some embodiments, multiple cables 15 may be interconnected together, with each cable 15 including a first connector 20 comprised of a male coupler 24 at its first end and a second connector 50 comprised of a female coupler 54 at its second end.

The figures illustrate a first connector 20 including a housing 23 and a male coupler 24 and a second connector 50 including a housing 53 and a female coupler 24. It should be appreciated that the housings 23, 53 and couplers 20, 50 may be integrally formed in some embodiments. For example, the housing 23 of the first connector 20 may be integrally formed with the male coupler 24 and the housing 53 of the second connector 50 may be integrally formed with the female coupler 54.

The couplers 24, 54 and housings 23, 53 may be constructed of conventional electrically non-conductive insulating material. A wide range of materials may be utilized, such as but not limited to a variety of moldable plastics and polymers. The couplers 24, 54 and housings 23, 53 may be formed by a wide range of methods and processes, such as but not limited to conventional molding processes, machining processes, or combinations thereof. The couplers 24, 54 and housings 23, 53 may be separately molded and then connected together. In other embodiments, the housings 23, 53 may be over-molded on the couplers 24, 54 and cables 15.

The couplers 24, 54 will generally be formed in complimentary shapes so as to allow coupling by physical engagement of the male coupler 24 and the female coupler 54 in a manner which electrically connects the first connector 20 and the second connector 50. In exemplary embodiments, the male coupler 24 may comprise one or more first electrically conductive members such as electrical connectors 35 which are adapted to electro-mechanically engage with one or more second electrically conductive members such as electrical receivers 65 of the female coupler 54.

As shown in the figures, each of the connectors 20, 50 may comprise a recessed opening 27, 56. The recessed openings 27, 56 may be configured such that the connectors 20, 50 may be matingly engaged such as shown in FIG. 13. The first connector 20 may include a first keying mechanism 26 and the second connector 50 may comprise a second keying mechanism 55 such as shown in FIGS. 1-5. The complimentary keying mechanisms 26, 55 may be formed on or as part of the male and female couplers 24, 54 to restrict the orientations of the first and/or second connectors 20, 50 to particular orientations in order to allow a connection between the male and female couplers 24, 54. The keying mechanisms 26, 55 may also function to prevent rotation of either of the connectors 20, 50 when they are coupled together with the couplers 24, 54.

While the figures illustrate the keying mechanisms 26, 55 as comprising flattened portions of the otherwise annular couplers 24, 54, it should be appreciated that a wide range of other types of keying mechanisms 26, 55 comprising various interlocking shapes may be utilized. As another example, the keying mechanisms 26, 55 could in some embodiments comprise a projection and a corresponding opening, with the projection preventing the respective coupler 24, 54 from coupling with the other respective coupler 24, 54 unless the projection is properly aligned with the corresponding opening.

Figure 11:
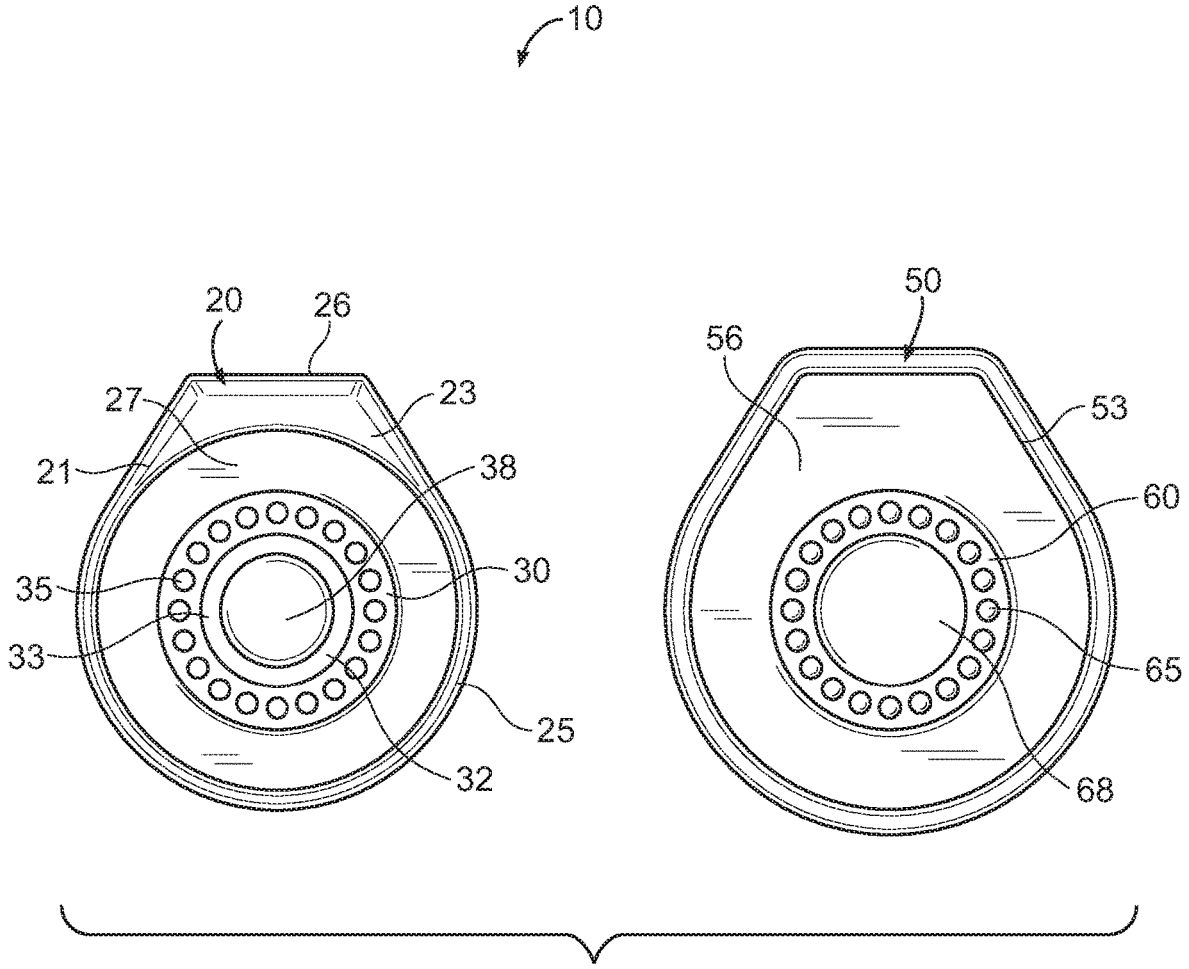
FIG. 11 is a frontal view of a first connector and a second connector of a vibrating connector system in accordance with an example embodiment.

As shown in FIG. 11, each of the housings 23, 53 are similarly formed in complimentary shapes so as to facilitate the receipt and retention of the respective male and female couplers 24, 54 and to facilitate coupling the connectors 20, 50. The exterior surfaces of the housings 23, 53 may be ergonomically shaped so as to facilitate the grasping and manipulation of the connectors 20, 50 to ease coupling and decoupling of the couplers 24, 54.

As shown throughout the figures, one or both of the first and second connectors 20, 50 may comprise a vibrating element 40 which is adapted to provide a haptic response, such as vibrations, to indicate that the first and second connectors 20, 50 have been electrically connected together. While the figures primarily illustrate the vibrating element 40 as being connected to or forming part of the first connector 20 with a male coupler 24, it should be appreciated that the female coupler 54, such as on the second connector 50, may alternatively include the vibrating element 40. In some embodiments, both of the connectors 20, 50 may comprise its own vibrating element 40 such that both the first connector 20 and the second connector 50 each vibrate when an electrical connection is made.

i. First Connector.

Figure 2:
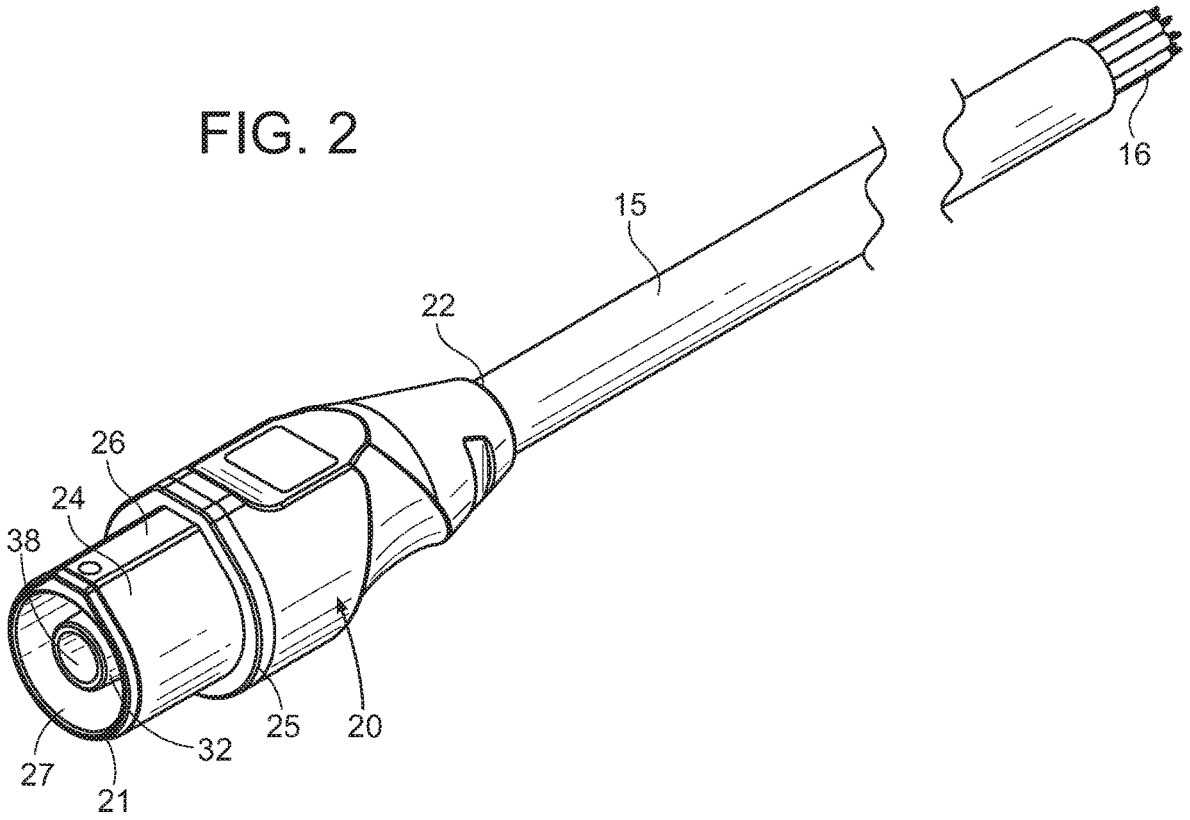
FIG. 2 is a second perspective view of a first connector of a vibrating connector system in accordance with an example embodiment.
Figure 3:
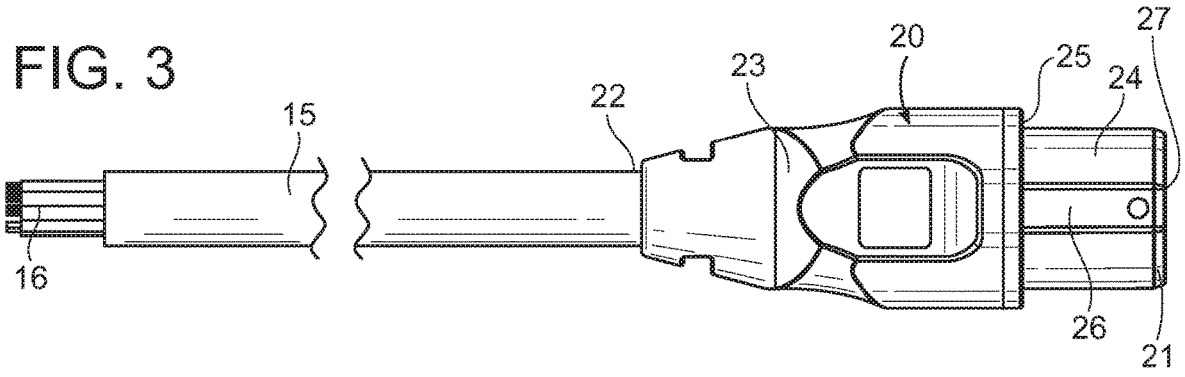
FIG. 3 is a top view of a first connector of a vibrating connector system in accordance with an example embodiment.

FIGS. 1-6 illustrate an exemplary first connector 20 including a male coupler 24 for use with the vibrating connector system 10. The first connector 20 may comprise a front end 21 and a rear end 22. As shown in FIG. 2, the front end 21 of the first connector 20 may include a male coupler 24 which is adapted to matingly and removably engage with a corresponding female coupler 54 on a second connector 50. In some embodiments, the first connector 20 may instead comprise a female coupler 54 and the second connector 50 may instead comprise a male coupler 24. The rear end 22 of the first connector 20 will generally be connected to a cable 15 or component 18 so as to electrically connect with one or more wires 17 such as shown in FIG. 2.

Figure 12:
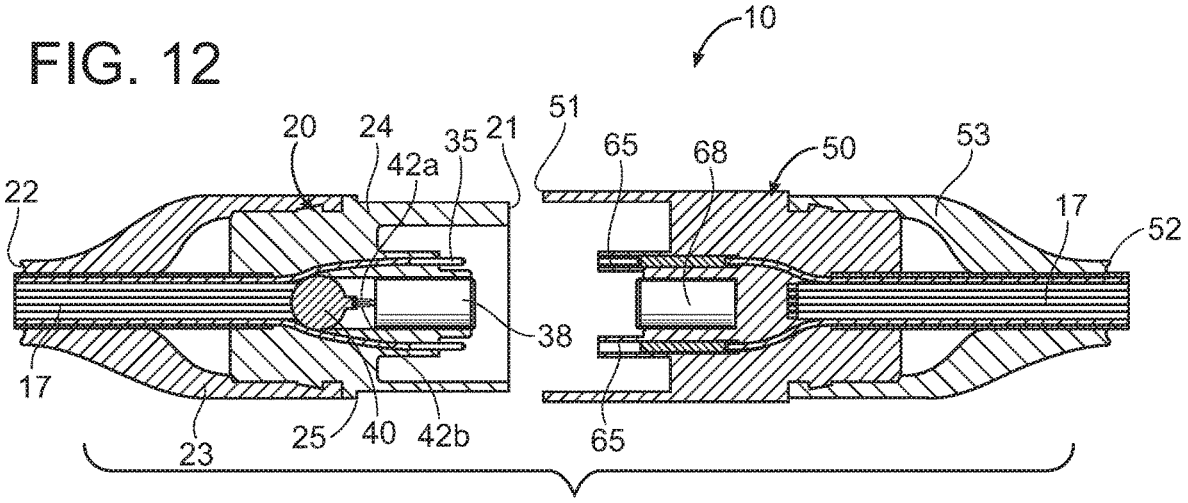
FIG. 12 is a side sectional view of a first connector aligned for connection to a second connector comprised of an in-line connector of a vibrating connector system in accordance with an example embodiment.
Figure 15:
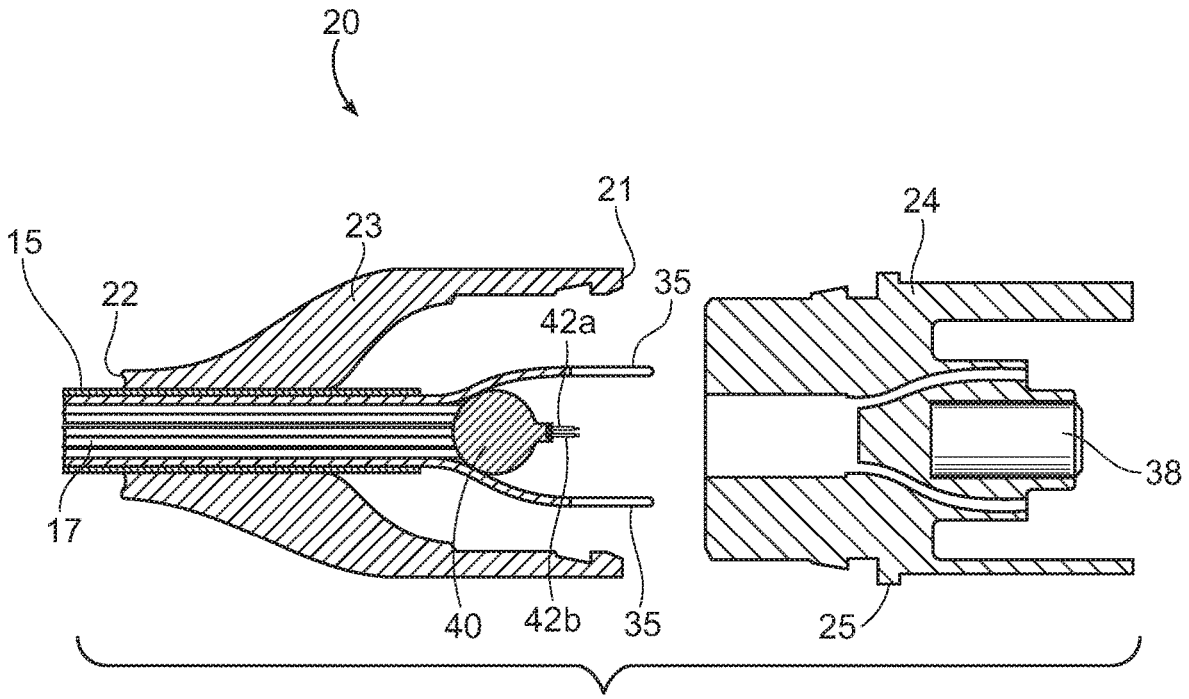
FIG. 15 is a side sectional view of a first connector of a vibrating connector system in accordance with an example embodiment.

As shown in FIGS. 12, 13, and 15, the first connector 20 may comprise a housing 23 in which various components of the vibrating connector system 10 may be positioned. The shape, size, and configuration of the housing 23 may vary in different embodiments and thus should not be construed as limited by the exemplary figures. In the exemplary embodiment shown in FIG. 6, the housing 23 includes a housing cavity 29 in which various components of the system 10 may be positioned.

The housing 23 may include ergonomic features to aid in grasping the housing 23 when connecting or disconnecting the first connector 20. The rear end 22 of the housing 23 may include an opening through which a cable 15 and wires 17 may enter into the housing cavity 29. In the exemplary embodiment shown in FIGS. 1-4, the housing 23 is positioned at or near the distal end 16 of such a cable 15. In other embodiments, the housing 23 may be connected instead to a component 18 such as a computer system or device.

As shown in FIGS. 12, 13, and 15, the housing 23 may include a male coupler 24 which is adapted to matingly and removably engage with a corresponding female coupler 54 on a second connector 50. The shape of the male coupler 24 may vary widely in different embodiments. In the exemplary embodiment shown in the figures, the male coupler 24 is illustrated as comprising a substantially cylindrical shape, with a keying mechanism 26 comprised of a trapezoidal extension that functions to ensure proper insertion and engagement of the male coupler 24, and to prevent rotation of the male coupler 24 when so engaged.

In the exemplary embodiments shown in the figures, the housing 23 is illustrated as comprising the rear end 22 of the first connector 20 and the male coupler 24 is illustrated as comprising the front end 21 of the first connector 20. In some embodiments, the housing 23 and male coupler 24 may be integrally formed. In other embodiments, the housing 23 may be adapted to removably connect to the male coupler 24, such as by the use of threading, frictional engagement, or the like.

Figure 4:
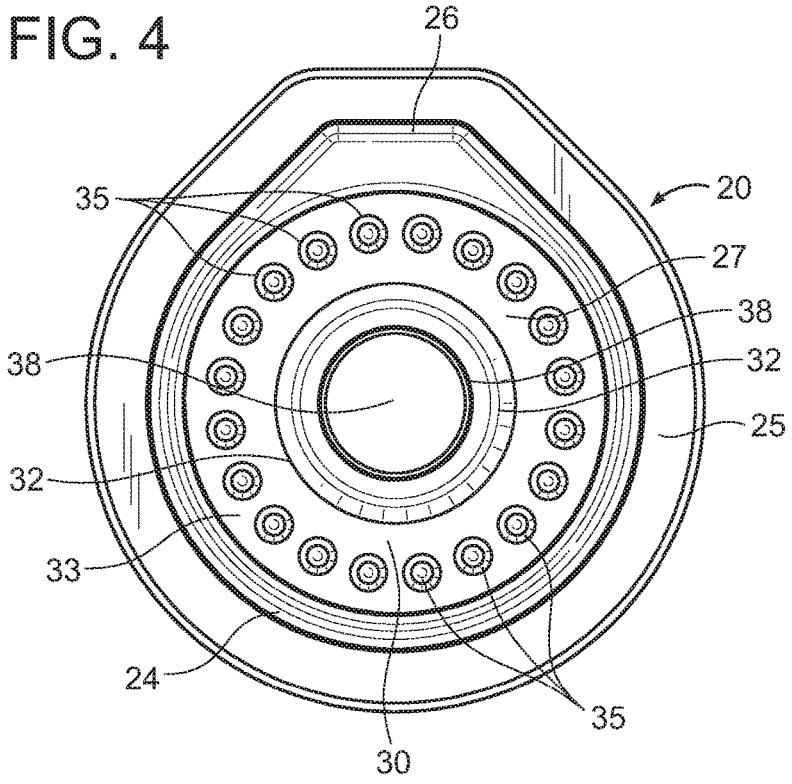
FIG. 4 is a front view of a first connector of a vibrating connector system in accordance with an example embodiment.

As shown in FIGS. 2 and 4, the front end 21 of the first connector 20 may comprise a recessed opening 27 in which a retaining structure 30 is positioned with electrical connector 35. The recessed opening 27 may comprise a cylindrical cavity such as shown in FIG. 2, or may comprise other shapes, dimensions, and configurations. The depth of the recessed opening 27 may vary depending upon the embodiment being utilized.

In some embodiments, the front end 21 of the first connector 20 may omit such a recessed opening 27, with the electrical connector(s) 35 extending outwardly from the front end 21 of the first connector 20 rather than being recessed within a recessed opening 27. For example, the systems and methods described herein may be utilized with a universal serial bus (USB) cable which utilizes a single electrical connector 35 as a male coupler 24 which extends outwardly from the front end 21 of a housing 23.

As shown in FIG. 2, the first connector 20 may comprise a flange 25 which acts as a stopper to prevent over-insertion of the male coupler 24 within the female coupler 54 of the second connector 50. In the embodiment shown in the figures, the flange 25 extends annularly around the periphery of the male coupler 24. In other embodiments, the flange 25 may extend annularly around the housing 23. In other embodiments, the flange 25 may be formed by use of a male coupler 24 which has a periphery which is narrower or smaller than the periphery of the housing 23 from which it extends.

Figure 5:
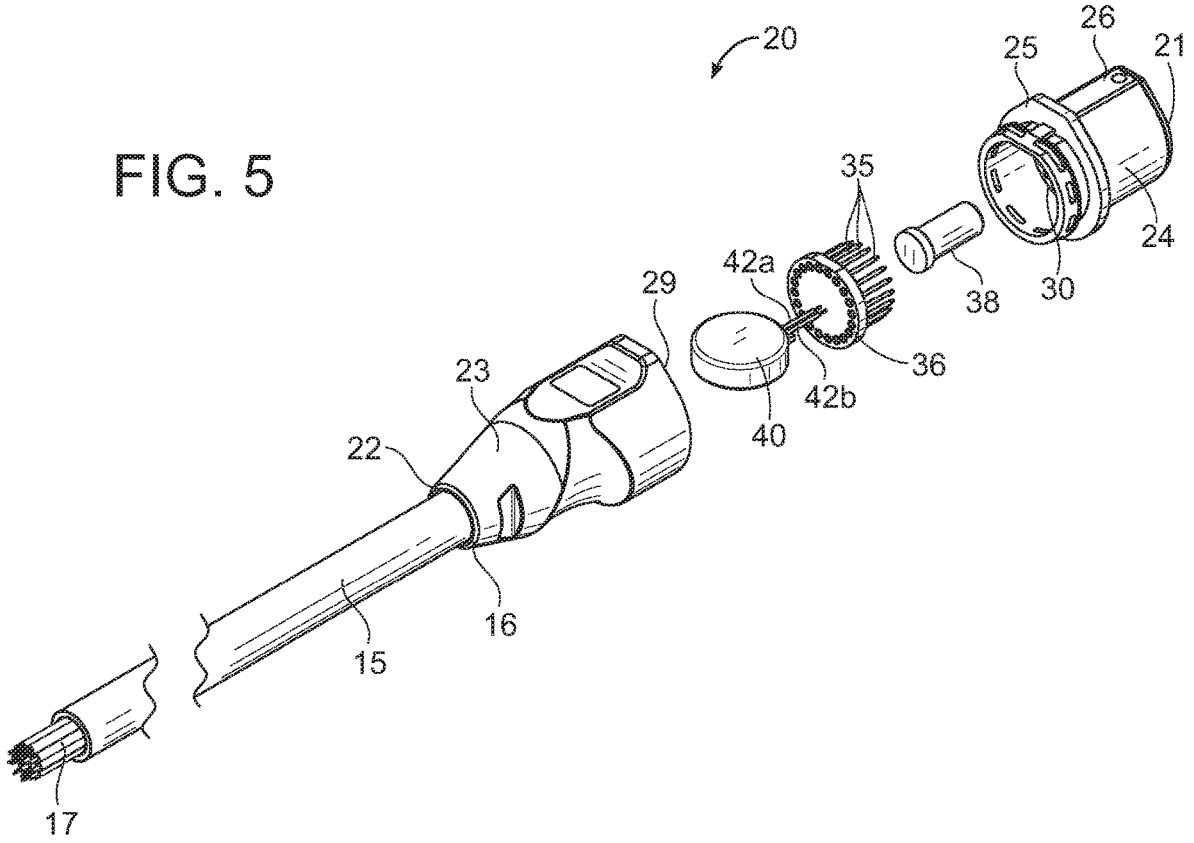
FIG. 5 is a first exploded view of a first connector of a vibrating connector system in accordance with an example embodiment.
Figure 6:
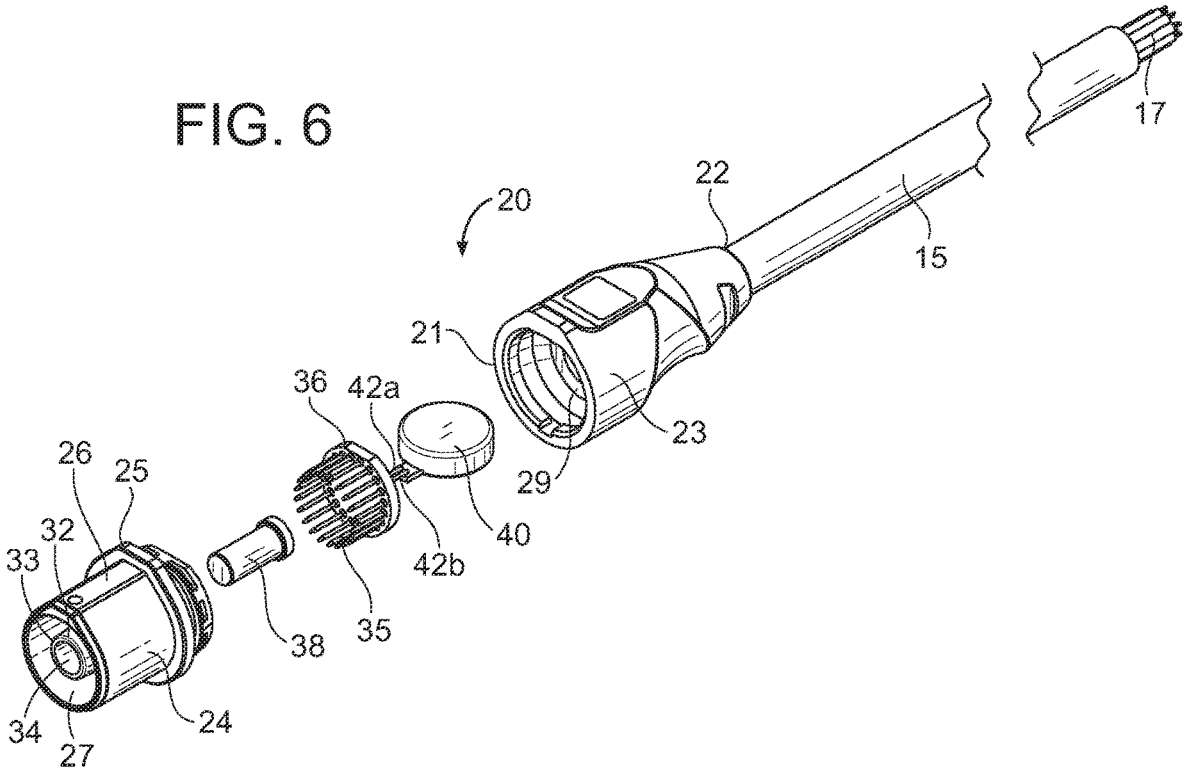
FIG. 6 is a second exploded view of a first connector of a vibrating connector system in accordance with an example embodiment.

With reference to FIGS. 5 and 6, it can be seen that the housing 23 of the first connector 20 may comprise a housing cavity 29. The housing cavity 29 may comprise a space within the housing 23 in which various components such as circuitry, the vibrating element 40, wires 17, and/or other components may be positioned. The shape, size, and configuration of the housing cavity 29 may vary in different embodiments. In the exemplary embodiment shown in the figures, the housing cavity 29 is comprised of a substantially cylindrical cavity within the housing 23.

As shown in FIGS. 4 and 5, the first connector 20 may comprise one or more electrical connectors 35 which are adapted to matingly and electrically engage with corresponding electrical receivers 65 on the second connector 50. The shape, configuration, and size of the electrical connectors 35 may vary in different embodiments. In some embodiments, a single electrical connector 35 may be utilized, such as is common with a universal serial bus (USB) connector, for example. In other embodiments such as shown in the figures, a plurality of electrical connectors 35 may be utilized.

Each electrical connector 35 will generally comprise a conductive connector adapted to transmit electrical power or signals. In some embodiments, each electrical connectors 35 may comprise an electrically-conductive pin. In the embodiment shown in FIG. 6, it can be seen that a plurality of electrical connectors 35 are shown as comprising a plurality of electrically-conductive pins arranged in a circular orientation. It should be appreciated that different arrangements may be utilized and thus the scope should not be construed as limited to a circular orientation where multiple electrical connectors 35 are used.

The electrical connectors 35 may be comprised of various materials such as but not limited to electrically conductive materials such as various metals, alloys, and the like. The electrical connectors 35 may comprise various types of projections, such as but not limited to pins, plugs, screws, or the like. The number of electrical connectors 35 utilized will vary depending on the type of connectors 20, 50 being used and the end-application.

In the exemplary embodiment shown in the figures, the one or more electrical connectors 35 may be connected to a retaining structure 30. In the exemplary embodiment shown in FIG. 4, a plurality of electrical connectors 35 are shown as extending through a retaining structure 30 in a circular arrangement. In other embodiments, the shape of the retaining structure 30 may vary to accommodate the desired arrangement of any electrical connectors 35. In other embodiments, the retaining structure 30 may be omitted.

The shape, size, positioning, and configuration of the retaining structure 30 may vary in different embodiments. Generally, the retaining structure 30 will be positioned within the recessed opening 27 of the first connector 20. However, in some embodiments, the retaining structure 30 may instead extend outwardly from the front end 21 of the first connector 20 rather than being recessed within the recessed opening 27. In such embodiments, the retaining structure 30 may be external to the housing 23.

In the exemplary embodiment best shown in FIG. 2, the retaining structure 30 is illustrated as being positioned within the recessed opening 27 of the male coupler 24 of the first connector 20. The retaining structure 30 may be substantially cylindrical in shape as shown in the figures, or may comprise other shapes as previously mentioned. The retaining structure 30 may extend outwardly and forwardly within the recessed opening 27 substantially coaxial with a longitudinal axis extending through the first connector 20.

In the exemplary embodiment shown in the figures, the retaining structure 30 is recessed within the first connector 20 and does not extend beyond the distal front end 21 of the first connector 20. As previously mentioned, such an embodiment is not limiting as the retaining structure 30 may extend beyond the front end 21 of the first connector 20 in some embodiments.

As shown in FIGS. 4, 5, and 11, the retaining structure 30 may comprise an alignment shoulder 32 which extends outwardly toward or from the front end 21 of the first connector 20, depending on whether and how much the retaining structure 30 is recessed within the first connector 20. The shoulder 32 may comprise a cylindrical or annular projection including a cavity 34 such as shown in FIG. 2. The shoulder 32 may extend annularly around the periphery of the retaining structure 30 at a location which is recessed with respect to the front end 21 of the first connector 20.

As shown in FIG. 2, the shoulder 32 may comprise a forward face 33 through which the electrical connectors 35 may extend or to which the electrical connectors 35 may be connected. The forward face 33 may comprise one or more openings through which the electrical connector(s) 35 may extend. The electrical connector(s) 35 may be secured within such openings, such as by an adhesive or other type of fastener, or may simply extend through such openings without any specific adhesive or the like to retain them therein.

As shown in FIG. 6, the retaining structure 30 may comprise a cavity 34. The cavity 34 may comprise various shapes and sizes. In the exemplary embodiment shown in FIG. 6, the cavity 34 is illustrated as comprising a cylindrical opening. The cavity 34 may be substantially coaxial with respect to a longitudinal axis extending through the body of the first connector 20. As discussed below and shown in the figures, the cavity 34 may be adapted to receive and retain a first magnetic latching element 38.

FIGS. 5 and 6 illustrate an exploded view of a first connector 20. As can be seen in that exemplary embodiment, a plurality of electrical connectors 35 each comprising an electrically-conductive pin is shown being connected in a circular orientation around a connector hub 36. The connector hub 36 may maintain the electrical connectors 35 in a desired arrangement with respect to each other. The connector hub 36 may comprise various materials, and in some embodiments may comprise a pin plug insulator.

As shown in FIG. 6, the connector hub 36 will generally include a plurality of electrical connectors 35 secured thereto. The electrical connectors 35 may be secured to the connector hub 36 in various manners, such as by press-fitting, soldering, frictional engagement, use of adhesives, use of fasteners, and the like. The electrical connectors 35 may comprise solder cups, solder tails, crimp structure, or a combination of elements to facilitate soldered and/or mechanical electrical connection with the wires 17 of the cable 15.

Generally, each of the electrical connectors 35 will be electrically connected to one or more of the wires 17 of the cable 15. As an example, a wire 17 from the cable 15 may connected to the rear side of the connector hub 36 to electrically connect to one or more of the electrical connectors 35 being supported thereon. As a further example, the distal ends of the wires 17 may be connected to wire connectors or bonds on the rearward facing side or face of the connector hub 36, and the forward facing side or face of the connector hub 36 could contain lead lines and/or pins that extend outwardly from the connector hub 36 to serve as electrical connectors 35.

In some embodiments, the connector hub 36 may comprise a printed circuit board, flex circuit, integrated circuit, electrical circuitry, or the like. The connector hub 36 may include programming in some embodiments, such as programming to manage the duration, pattern, and other characteristics of the haptic feedback response provided by the vibrating element 40 when a connection is made between the first connector 20 and the second connector 50.

As shown in FIGS. 6 and 11-13, the first connector 20 may comprise a first magnetic latching element 38. The first magnetic latching element 38 will generally be comprised of a magnetic material, or be comprised of a magnetic attractive material such as a ferrous or ferromagnetic metal material. The type of material used for the first magnetic latching element 38 may vary in different embodiments so long as the selected material is magnetically attracted to that which is used for the second magnetic latching element 68 of the second connector 50. For example, the first magnetic latching element 38 of the first connector 20 may comprise a magnetic material and the second magnetic latching element 68 of the second connector 50 may be comprised of a metal material to which the magnet material of the first magnetic latching element 38 is attracted.

The shape, size, positioning, and configuration of the first magnetic latching element 38 may vary in different embodiments. In the embodiment shown in FIG. 6, the magnetic latching element 38 is illustrated as comprising a cylindrical member which is positioned within the recessed opening 27 of the male coupler 24 of the first connector 20. The magnetic latching element 38 may comprise a flat base portion which rests against the connector hub 36 as shown in FIG. 6.

The first magnetic latching element 38 will generally be positioned within the cavity 34 of the retaining structure 30, with the electrical connectors 35 being recessed slightly with respect to the first magnetic latching element 38 such that the first magnetic latching element 38 extends outwardly from the distal ends of the electrical connectors 35. In some embodiments, the first magnetic latching element 38 may be recessed with respect to the electrical connectors 35. Any configuration and positioning may be utilized so long as the first magnetic latching element 38 is capable of contacting and engaging with a corresponding second magnetic latching element 68 when the connectors 20, 50 are engaged and connected to each other.

FIGS. 1 and 2 illustrate a first embodiment of a first connector 20. As can be seen, the first connector 20 is positioned at the distal end of a cable 15. The cable 15 encloses one or more electrical wires 17 which are electrically connected to the electrical connectors 35 of the first connector 20. A housing 23 is secured to the cable 15, with the cable 15 extending into the housing 23 in some embodiments. A male coupler 24 is connected to the housing 23, with the male coupler 24 comprising a structure adapted to engage with a corresponding female coupler 54 on the second connector 50. The male coupler 24 may include a keying mechanism 26 to ensure proper connection and to prevent rotation when connected.

FIGS. 5 and 6 illustrate exploded views of the first connector 20. As can be seen, the cable 15 and electrical wires 17 extend into the rear end 22 of the housing 23. The housing 23 may be tapered from front-to-back as shown in the figures, or may comprise other configurations. The housing 23 may include ergonomic features such as shown in the figures. The housing 23 includes a housing cavity 29 in which various components of the first connector 20 may be stored.

Continuing to reference FIGS. 5 and 6, it can be seen that a vibrating element 40, such as a rotating disk motor 44, may be positioned and secured within the housing cavity 29 of the housing 23. The vibrating element 40 may be electrically connected to one or more electrical connectors 35 such that the vibrating element 40 is activated when the one or more electrical connectors 35 are electrically connected to one or more electrical receivers 65 on the second connector 50. The electrical connectors 35 will generally be arranged on a connector hub 36, with the connector hub 36 being secured and positioned within the housing cavity 29 of the housing 20. The first magnetic latching element 38 may also be positioned at least partially within the housing 20, such as between the electrical connectors 35 as shown in the figures.

Continuing to reference FIGS. 5 and 6, it can be seen that a male coupler 24 may be connected to the frontal end of the housing 23 to enclose the housing cavity 29. The manner in which the male coupler 24 is connected to the housing 23 may vary. The male coupler 24 may be fixedly or removably connected to the housing 23. In some embodiments, the male coupler 24 may be removably connected to the housing 23, such as by use of threaded engagement, clamps, frictional engagement, or the like. In other embodiments, the male coupler 24 may be integrally formed with respect to the housing 23.

As shown, the male coupler 24 includes a retaining structure 30 through which the electrical connectors 35 may extend. The retaining structure 30 may be integral with respect to the male coupler 24 or may be connected thereto. The male coupler 24 may include a recessed opening 27 in which the electrical connectors 35 and first magnetic latching element 38 are positioned.

ii. Second Connector.

Figure 9:
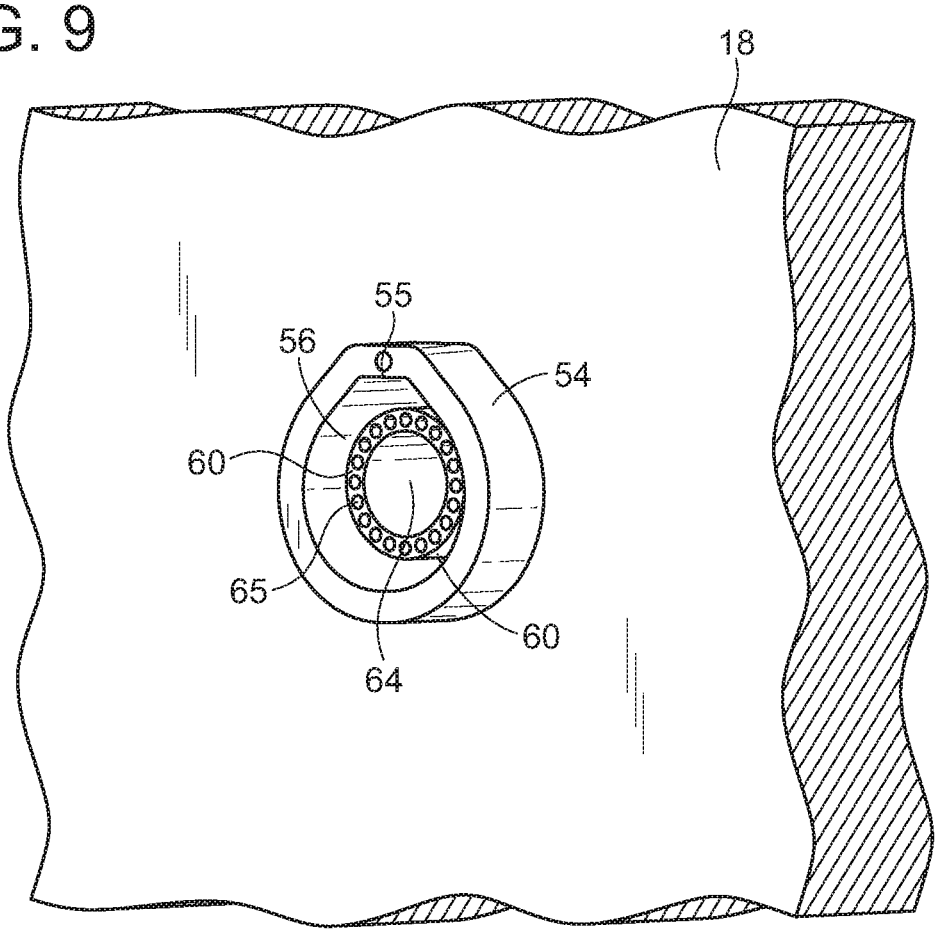
FIG. 9 is a perspective view of a second connector comprised of a panel mount connector connected to a component of a vibrating connector system in accordance with an example embodiment.
Figure 10:
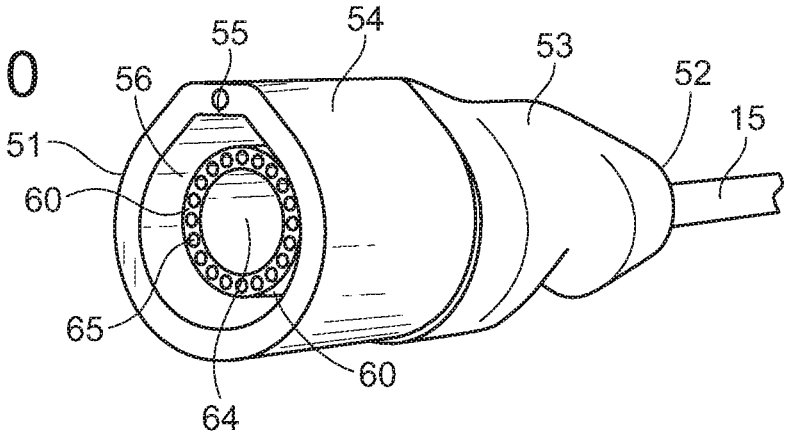
FIG. 10 is a perspective view of a second connector comprised of an in-line connector connected to a distal end of a cable of a vibrating connector system in accordance with an example embodiment.

FIGS. 9 and 10 illustrate an exemplary second connector 50 including a female coupler 54 for use with the vibrating connector system 10. The second connector 50 may comprise second electrically conductive members comprised of electrical connectors 35 or electrical receivers 65. The first second 50 may comprise a front end 51 and a rear end 52. As shown in FIG. 9, the front end 51 of the second connector 50 may include a female coupler 54 which is adapted to matingly and removably engage with a corresponding male coupler 24 on a second connector 20. In some embodiments, the second connector 50 may instead comprise a male coupler 24 and the first connector 20 may instead comprise a female coupler 54. The rear end 22 of the second connector 50 will generally be connected to a cable 15 or component 18 so as to electrically connect with one or more wires 17 such as shown in FIG. 10.

FIGS. 9 and 10 illustrate two different embodiments of a second connector 50. In the first embodiment shown in FIG. 9, the second connector 50 is illustrated as comprising a panel mount connector being connected to a component 18 such as a computer, device, wall, vehicle, or the like. In the second embodiment shown in FIG. 10, the second connector 50 is illustrated as being comprised of an in-line connector connected to a cable 15. It should be appreciated that, in some embodiments, the first connector 20 may be connected to a component 18 such as is shown in FIG. 9 with respect to the second connector 50.

Referring to FIG. 9, it can be seen that the second connector 50 is recessed within the component 18, with only the front end 51 of the second connector 50 comprising the female coupler 54 extending from the component 18. The rear end 52 of the second connector 52 is recessed within the component 18 and may comprise a housing 53 which stores the various components of the second connector 50. The shape, size, and configuration of the housing 53 of the second connector 50 may vary in different embodiments and thus should not be construed as limited by the exemplary figures.

In an embodiment such as shown in FIG. 10 in which the second connector 50 is connected to a distal end of a cable 15, the housing 53 of the second connector 50 may include ergonomic features to aid in grasping the housing 53 when connecting or disconnecting the second connector 50. The rear end 52 of the housing 23 may include an opening through which a cable 15 and wires 17 may enter into the housing 53. In the exemplary embodiment shown in FIG. 10, the housing 53 is positioned at or near the distal end 16 of such a cable 15. In other embodiments such as shown in FIG. 9, the housing 53 may be connected instead to a component 18 such as a computer system or device, with the housing 53 being either fully or partially recessed within the component 18. In other embodiments, the entire housing 53 may extend outwardly from the component 18.

As shown in FIG. 10, the housing 53 of the second connector 50 may include a female coupler 54 which is adapted to matingly and removably engage with a corresponding male coupler 24 on a first connector 20. The shape of the female coupler 54 may vary widely in different embodiments. In the exemplary embodiment shown in FIG. 10, the female coupler 54 is illustrated as comprising a substantially cylindrical shape, with a keying mechanism 55 comprised of a trapezoidal extension that functions to ensure proper insertion and engagement of the male coupler 24, and to prevent rotation of the male coupler 24 when so engaged within the female coupler 54. The housing 53 of the second connector 50 may include a front end 51 which comprises an inner diameter of such dimensions so as to allow the male coupler 24 to be inserted within the front end 51 of the second connector 50.

In the exemplary embodiment shown in FIG. 10, the housing 53 of the second connector 50 is illustrated as comprising the rear end 52 of the second connector 50 and the female coupler 54 is illustrated as comprising the front end 51 of the second connector 50. In some embodiments, the housing 53 and female coupler 54 may be integrally formed. In other embodiments, the housing 54 may be adapted to removably connect to the female coupler 54, such as by the use of threading, frictional engagement, or the like.

As shown in FIGS. 9 and 10, the front end 51 of the second connector 50 may comprise a recessed opening 56 in which a retaining structure 60 is positioned with one or more electrical receivers 65. The recessed opening 56 may comprise a cylindrical cavity such as shown in FIG. 10, or may comprise other shapes, dimensions, and configurations. The depth of the recessed opening 56 may vary depending upon the embodiment being utilized. In some embodiments, the front end 51 of the second connector 50 may omit such a recessed opening 56, with the electrical receiver(s) 65 extending outwardly from the front end 51 of the second connector 50 rather than being recessed within a recessed opening 56.

In the exemplary embodiment shown in the figures, the one or more electrical receivers 65 may be connected to a retaining structure 60. In the exemplary embodiment shown in FIGS. 9 and 10, a plurality of electrical receivers 65 are shown as being positioned in a circular orientation within a retaining structure 60 comprised of a circular arrangement. In other embodiments, the shape of the retaining structure 60 may vary to accommodate the desired arrangement of any electrical receivers 65 which may also vary in different embodiments. In other embodiments, the retaining structure 60 may be omitted, with the one or more electrical receivers 65 being incorporated directly within the female coupler 54.

The shape, size, positioning, and configuration of the retaining structure 60 may vary in different embodiments. Generally, the retaining structure 60 will be positioned within the recessed opening 56 of the second connector 50. However, in some embodiments, the retaining structure 60 may instead extend outwardly from the front end 51 of the second connector 50 rather than being recessed within a recessed opening 56. In such embodiments, the retaining structure 60 may be external to the housing 53.

In the exemplary embodiment best shown in FIG. 9, the retaining structure 60 is illustrated as being positioned within the recessed opening 56 of the female coupler 54 of the second connector 50. The retaining structure 60 may be substantially cylindrical in shape as shown in the figures, or may comprise other shapes as previously mentioned. The retaining structure 60 may extend outwardly and forwardly within the recessed opening 56 substantially coaxial with a longitudinal axis extending through the second connector 50.

In the exemplary embodiment shown in the figures, the retaining structure 60 is recessed within the second connector 50 and does not extend beyond the distal front end 51 of the second connector 50. As previously mentioned, such an embodiment is not limiting as the retaining structure 60 may extend beyond the front end 51 of the second connector 50 in some embodiments.

As shown in FIG. 9, the retaining structure 60 may comprise a cavity 64. The cavity 64 may comprise various shapes and sizes. In the exemplary embodiment shown in FIG. 9, the cavity 64 is illustrated as comprising a cylindrical opening. The cavity 64 may be substantially coaxial with respect to a longitudinal axis extending through the body of the second connector 50. The cavity 64 may be recessed rearward of the front end 51 of the second connector 50. As discussed below and shown in the figures, the cavity 34 may be adapted to receive and retain a second magnetic latching element 68.

Figure 16:
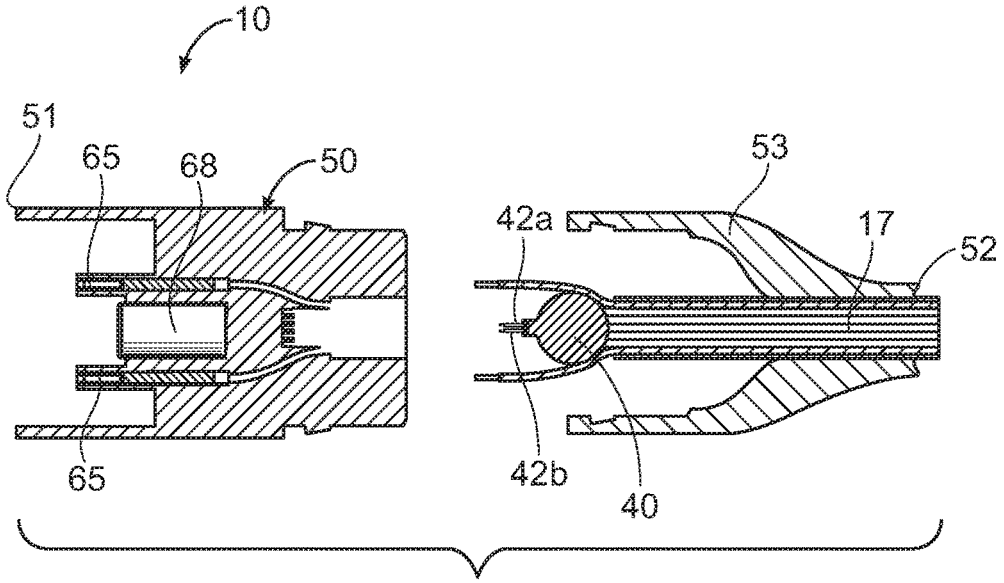
FIG. 16 is a side sectional view of a second connector of a vibrating connector system in accordance with an example embodiment.

FIGS. 9, 10, and 16 illustrate an exemplary embodiment of a second connector 50 which is adapted to electrically connect with the first connector 20. In the exemplary embodiment shown in FIGS. 9, 10, and 16, the second connector 50 includes a plurality of electrical receivers 65 each being adapted to at least partially receive one or more electrical connectors 35 to complete an electrical connection between the first connector 20 and the second connector 50. It should be appreciated that a wide range of types of electrical receivers 65 may be utilized, comprising various sockets, openings, receptacles, and the like which are adapted to electrically connect with a corresponding electrical connector 35 inserted at least partially within the electrical receiver 65.

The electrical receivers 65 may be connected to a retaining structure 60 such as shown in FIG. 9. In such an embodiment, the retaining structure 60 may include one or more electrical receivers 65 adapted to at least partially receive at least one electrical connector 35 from the first connector 50. In the exemplary embodiment shown in FIG. 9, the retaining structure 60 comprises a cylindrical member having a circular face on which is arranged a plurality of electrical receivers 65 and a cavity 64 around which the electrical receivers 65 are arranged. The shape, size, and structure of the retaining structure 60 may vary in different embodiments and thus should not be construed as limited by the exemplary cylindrical shape shown in the figures. In some embodiments, the retaining structure 60 may comprise a square-shaped cross-section. In other embodiments, the retaining structure 60 may be omitted.

In the exemplary embodiment shown in FIGS. 9, 10, and 16, the electrical receivers 65 are shown as comprising a plurality of electrically-conductive sockets which are arranged in a circular orientation within the recessed opening 56 of the second connector 50. The electrical receivers 65 may be constructed of various electrically conductive materials such as metals, metal alloys, and the like.

It should be appreciated that the placement, structure, and number of electrical receivers 65 used in the second connector 50 may vary in different embodiments. By way of example, in some embodiments, the second connector 50 may comprise only a single electrical receiver 65. In other embodiments, multiple electrical receivers 65 may be utilized. The orientation of the electrical receivers 65 may also vary, and thus the scope should not be construed as limited to electrical receivers 65 arranged in a circular orientation as shown in the exemplary embodiment of the figures.

In the exemplary embodiment shown in FIG. 9, the electrical receivers 65 are illustrated as being positioned within the recessed opening 56 of the female coupler 54 of the second connector 50. However, in some embodiments, the electrical receivers 65 may not be recessed with respect to the front end 51 of the second connector 50. In some embodiments, the electrical receivers 65 may be positioned at the front end 51 of the second connector 50 without being recessed.

As shown in FIGS. 12, 13, and 16, each of the electrical receivers 65 may be electrically connected to one or more wires 17. In the exemplary embodiment shown in FIG. 9, the wires 17 may be internal to the component 18 and connected within the housing 53 to the electrical receivers 65. In the exemplary embodiment shown in FIG. 10, the wires 17 may be positioned within a cable 15, with the second connector 50 being positioned at the distal end of the cable 15 and the wires 17 being connected within the housing 53 to the electrical receivers 65.

As shown in FIGS. 12 and 13, the second connector 50 may comprise a second magnetic latching element 68. The second magnetic latching element 68 will generally be comprised of a magnetic material, or be comprised of a magnetic attractive material such as a ferrous or ferromagnetic metal material. The type of material used for the second magnetic latching element 68 may vary in different embodiments so long as the selected material is magnetically attracted to that which is used for the first magnetic latching element 38 of the first connector 20. For example, the second magnetic latching element 68 of the second connector 50 may comprise a magnetic material and the first magnetic latching element 38 of the first connector 20 may be comprised of a metal material to which the magnet material of the second magnetic latching element 68 is attracted.

The shape, size, positioning, and configuration of the second magnetic latching element 68 may vary in different embodiments. In the embodiment shown in FIG. 12, the second magnetic latching element 68 is illustrated as comprising a cylindrical member which is positioned within the recessed opening 56 of the female coupler 54 of the second connector 50.

The second magnetic latching element 68 will generally be positioned within the cavity 64 of the retaining structure 60, with the electrical receivers 65 being recessed slightly with respect to the second magnetic latching element 68 such that the second magnetic latching element 68 extends outwardly from the distal ends of the electrical receivers 65. In some embodiments, the second magnetic latching element 68 may be recessed with respect to the electrical receivers 65. Any configuration and positioning may be utilized so long as second magnetic latching element 68 is capable of contacting and engaging with a corresponding first magnetic latching element 38 when the connectors 20, 50 are engaged and connected to each other.

As can be seen in FIG. 10, the second connector 50 may be positioned at the distal end of a cable 15. The cable 15 encloses one or more electrical wires 17 which are electrically connected to the electrical receivers 65 of the second connector 50. A housing 53 is secured to the cable 15, with the cable 15 extending into the housing 53 in some embodiments. A female coupler 54 is connected to the housing 53, with the female coupler 54 comprising a structure adapted to engage with a corresponding male coupler 24 on the first connector 20. The female coupler 54 may include a keying mechanism 55 to ensure proper connection and to prevent rotation when connected.

As can be seen in FIG. 9, the second connector 50 may also be positioned as part of a component 18 such as a device, wall, or the like. By way of example and without limitation, the component 18 may comprise devices such as televisions, speakers, computers, smart phones, smart watches, tablets, medical devices such as electrocardiographs, electrical devices such as oscillators, or any other component 18 adapted to receive power or a signal via a cable 15.

Continuing to reference FIG. 9, it can be seen that the second connector 50 is incorporated into a component 18. The second connector 50 may be adapted to transmit electrical power or signals to the component 18. As can be seen, the housing 53 may be recessed within the component 18. In other embodiments, the housing 53 may be omitted. The female coupler 54 may extend outwardly from the component 18 such as shown in FIG. 9, or may be recessed within the component 18. In the exemplary embodiment of FIG. 9, the female coupler 54 extends out of the component 18, with the electrical receivers 65 being recessed within the recessed opening 56 of the female coupler 54.

With reference to FIG. 16, it can be seen that the second connector 50 may comprise a vibrating element 40, such as a rotating disk motor 44. The vibrating element 40 may be electrically connected to one or more electrical receivers 65 such that the vibrating element 40 is activated when the one or more electrical connectors 65 are electrically connected to one or more electrical connectors 35 of the first connector 20. The second magnetic latching element 68 may also be positioned at least partially within the housing 53, such as between the electrical receivers 65 as shown in the figures.

C. Vibrating Element.

As shown throughout the figures, the vibrating connector system 10 may utilize one or more vibrating elements 40 adapted to provide a haptic feedback response upon an electrical connection being made between the first and second connectors 20, 50. The vibrating element 40 may be connected to the first connector 20 as shown in FIG. 15 and/or to the second connector 50 as shown in FIG. 16. In some embodiments, both the first connector 20 and the second connector 50 may each include a vibrating element 40.

The vibrating element 40 is generally adapted to provide a haptic feedback response when the first connector 20 and second connector 50 are electrically connected. The type of haptic feedback response may vary in different embodiments. In some embodiments, the vibrating element 40 may vibrate to provide a haptic feedback response. The vibrating connector system 10 may also utilize additional feedback responses to indicate that the electrical connection has been made between the first and second connectors 20, 50 such as, for example, emitting an audible or visible indication of the electrical connection. In some embodiments, one or both of the connectors 20, 50 may include a light such as a light-emitting-diode (LED) which is adapted to illuminate upon an electrical connection being made between the connectors 20, 50.

The circumstances upon which the vibrating element 40 will activate to provide the haptic feedback response may vary in different embodiments. In some embodiments, the vibrating element 40 may activate to provide the haptic feedback response when an electrical connection is made between the first and second connectors 20, 50. In other embodiments, the vibrating element 40 may activate to provide the haptic feedback response when the first magnetic latching element 38 of the first connector 20 magnetically engages with the second magnetic latching element 68 of the second connector 50. The vibrating element 40 may also be configured to provide the haptic feedback response upon the first connector 20 and second connector 50 being disconnected from each other.

In yet other embodiments, a reverse configuration may be utilized wherein the vibrating element 40 provides the haptic feedback response upon the two connectors 20, 50 being in contact with each other but not completing an electrical connection. Such an embodiment may be utilized to provide the haptic feedback response upon a failed connection, rather than a successful connection.

The manner of vibration may also vary in different embodiments. For example, the vibrating element 40 may pulse for multiple vibrations or may emit a single vibration. The duration for which the vibrating element 40 vibrates may vary depending on the embodiment. In some embodiments, the vibrating element 40 may emit a single, quick pulse of vibration. In other embodiments, the vibrating element 40 may emit a long, uninterrupted vibration. In other embodiments, the vibrating element 40 may pulse with multiple vibrations within a set period of time.

In some embodiments, different types of vibrations may be utilized to convey different messages. For example, a first type of vibration comprised of a first duration and intensity may be provided by the vibrating element 40 upon the first and second connectors 20, 50 being electrically connected and a second type of vibration comprised of a second duration and intensity may be provided by the vibrating element 40 upon the first and second connectors 20, 50 being electrically disconnected. By way of further example, a third type of vibration comprised of a third duration and intensity may be provided by the vibrating element 40 upon the first and second connectors 20, 50 being physically engaged but not electrically connected.

In some embodiments, the vibrating element 40 may be programmable, such as by usage of a control unit. By way of example, the vibrating element 40 could contain circuitry such as logic circuitry which allows for the duration, intensity, and triggering conditions to be adjusted. Such circuitry could comprise analog or digital configurations, such as but not limited to the use of resistors, capacitors, diodes, programmable logic boards, microcontrollers, and the like to set the desired duration, intensity, and triggering conditions of the vibrating element 40. In other embodiments, the vibrating element 40 may be selected for a specific duration and intensity rather than being programmed.

Figure 21:
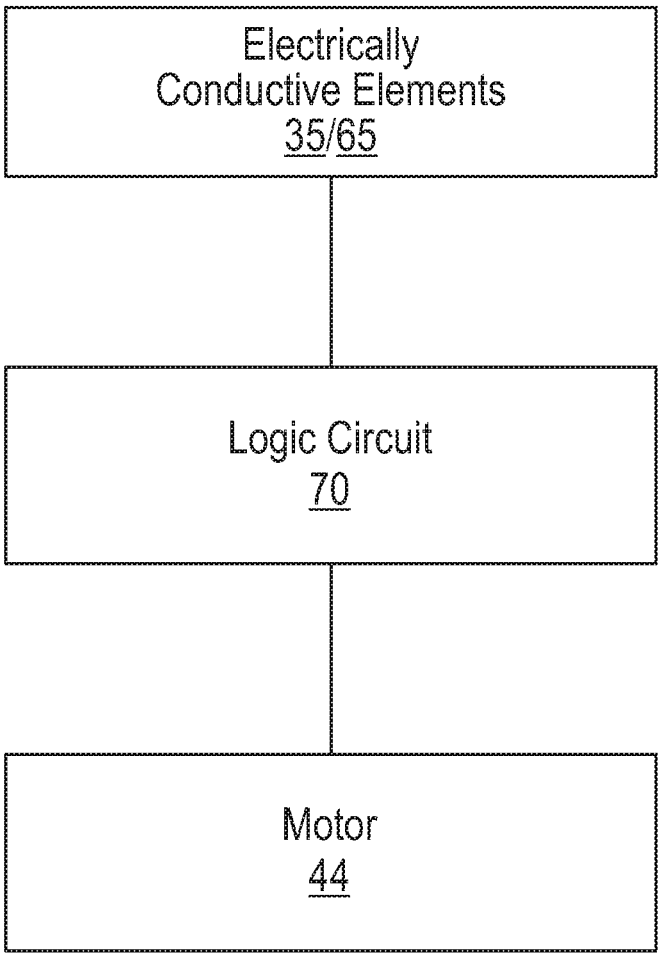
FIG. 21 is a block diagram illustrating connection of the vibrating element of a vibrating connector system in accordance with an example embodiment.

FIG. 21 illustrates an exemplary block diagram of the logic circuit 70 operatively connected to a vibrating element 40 of a locking connector system 10. In such an embodiment, the vibrating element 40 may be controlled by the logic circuit 70. For example, the logic circuit 70 may determine what conditions are necessary for activation of the vibrating element 40 to provide haptic feedback. As a further example, the logic circuit 70 may determine the type of haptic feedback (such as rapid pulses or a singular drawn out vibration) and the duration of the haptic feedback.

The logic circuit 70 may comprise analog and/or digital circuitry necessary to function as a control unit for the vibrating element 40. The logic circuit 70 may comprise electrically erasable programmable read-only memory (EEPROM) that may be programmed to control when, how, and how long the vibrating element 40 is activated. In such embodiments, the connector 20, 50 having the EEPROM may be adapted to be separately mated to a fixture such as a computer system to implement programming which is stored within its read-only memory to operate the vibrating element 40. In other embodiments, the logic circuit 70 may comprise one or more microcontrollers, logic boards, PLC's, and the like, or combinations thereof, for controlling the vibrating element 40.

In the exemplary embodiment of FIG. 21, the logic circuit 70 is connected between an electrically conductive element such as an electrical connector 35 or electrical receiver 65 and a vibrating element 40 comprised of an offset mass motor 44. It should be appreciated that this is merely an exemplary illustration of an exemplary embodiment, and thus the placement of the logic circuit 70 with respect to the electrically conductive elements 35, 65 and/or vibrating element 40 may vary in different embodiments.

The positioning of the vibrating element 40 within the first and/or second connectors 20, 50 may vary in different embodiments. In the exemplary embodiment shown in FIG. 15, the vibrating element 40 is shown as being positioned and connected within the housing 23 of the first connector 20. In such an embodiment, vibration motion from the vibrating element 40 is imparted to the housing 23 so as to provide the haptic feedback response to the user. In other embodiments, the vibrating element 40 may be positioned within the male coupler 24 of the first connector 20, the female coupler 54 of the second connector 50, or the housing 53 of the second connector 50.

FIG. 15 illustrates an exemplary embodiment of a first connector 20 in which the vibrating element 40 is positioned within the housing 23 of the first connector 20. In such an embodiment, the vibrating element 40 may be positioned behind the connector hub 36. The vibrating element 40 may include vibrating element connectors 42*a*, 42*b* which are connected to the connector hub 36 or the electrical connectors 35 of the first connector 20 so as to be in-line between the electrical connectors 35 and the wires 17. When a connection is completed, electrical current will flow through the vibrating element 40 to activate the haptic feedback response.

Figure 14:
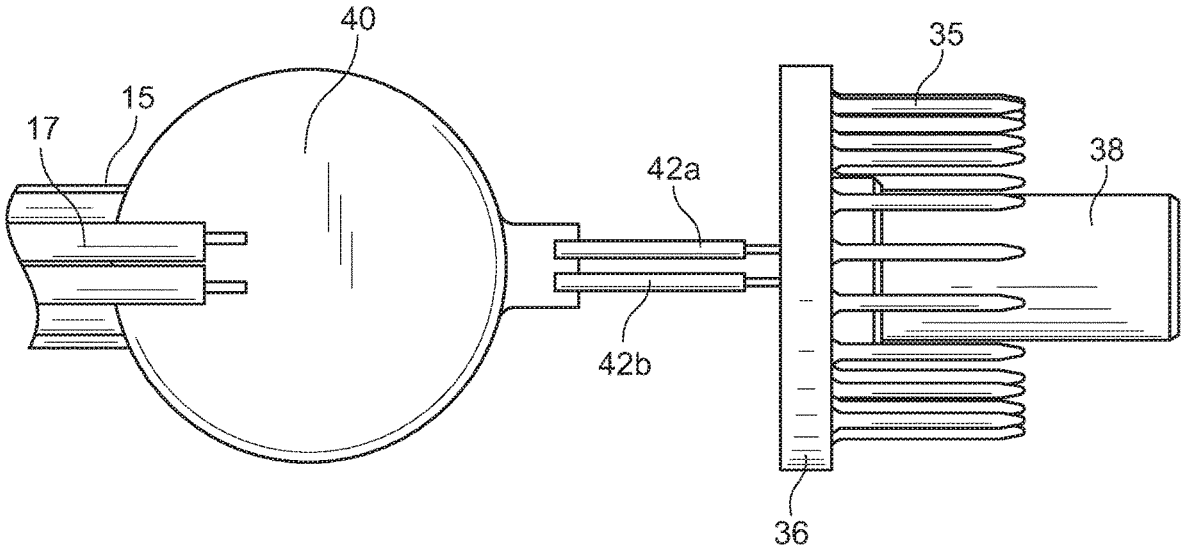
FIG. 14 is a side view of a vibrating element and electrical connectors of a first connector of a vibrating connector system in accordance with an example embodiment.

FIG. 14 illustrates an embodiment in which the vibrating element 40 is positioned in series between the wires 17 and the electrical connectors 35 of a first connector 20. As can be seen, the wires 17 may be connected directly to the vibrating element 40 on its first side, with the second side of the vibrating element 40 being connected by a first vibrating element connector 42*a* and a second vibrating element connector 42*b* to a plurality of electrical connectors 35 such that, when an electrical connection is made, electrical current will flow through the vibrating element 40 to activate the haptic feedback response.

FIG. 16 illustrates that the vibrating element 40 may additionally or alternatively be connected in series within a second connector 50. In such an embodiment, the vibrating element 40 may be positioned within the housing 53 or the female coupler 54 of the second connector 50. The vibrating element 40 may thus be positioned in series between the wires 17 of the second connector 50 and the electrical receivers 65 of the second connector 50 such that, when a connection is made with a first connector 20, electrical current flows through the vibrating element 40 to activate the haptic feedback response.

In some embodiments, the vibrating element 40 may be connected to the first magnetic latching element 38 of the first connector 20 so as to activate upon magnetic engagement with a corresponding second magnetic latching element 68 of a second connector 50. The reverse configuration could also be utilized, with the vibrating element 40 instead (or additionally) being connected to the second magnetic latching element 68 of the second connector 50 so as to activate upon magnetic engagement with the corresponding first magnetic latching element 38 of a first connector 50.

The manner in which the vibrating element 40 is connected to activate upon an electrical or magnetic connection being completed may vary in different embodiments. By way of example, the vibrating element 40 may be connected in series between the wires 17 and the electrical connectors 35 or electrical receivers 65 such that, when an electrical connection is completed, the vibrating element 40 is activated.

It should be appreciated that a wide range of vibrating elements 40 known to provide a haptic feedback response upon receiving an electrical current may be utilized. The vibrating element 40 may comprise an improperly balanced motor 44 which provides the haptic feedback response upon being activated. By way of example and without limitation, the vibrating element 40 may comprise a rotating disk motor 44 comprised of a rotating disk and an electrical motor to rotate the disk. The rotating disk will activate upon the electrical motor being activated by an electrical current, with the rotating disk provided the haptic feedback response such as vibrations.

In other embodiments, the vibrating element 40 may comprise various types of actuators and vibration motors. By way of example, an eccentric rotating mass vibration motor (ERM) 44 may be used in some embodiments in which a small unbalanced mass is connected on an electric motor such that, when the motor rotates, the mass creates a force that translates to vibrations. As a further example, a linear resonant actuator (LRA) may be utilized in which a small internal mass is attached to a spring which creates a force when driven. As a further example, a coin vibration motor may be utilized which relies on a rotating offset mass to provide the haptic feedback response.

The shape, size, and configuration of the vibrating element 40 may vary. The vibrating element 40 may comprise a coin (flat) configuration or a cylinder (bar) configuration. The figures illustrate a vibrating element 40 comprised of a coin configuration in which a circular, coin-shaped motor or actuator is used for the vibrating element 40. However, in alternate embodiments, a cylinder-shaped motor or actuator may be utilized. Any shape of vibrating element 40 may be utilized so long as it may be installed within the housing 23, 53 or coupler 24, 54 of a connector 20, 50.

D. Operation of Preferred Embodiment.

The vibrating connector system 10 may comprise various configurations in which the first connector 20 and/or the second connector 50 are adapted to provide a haptic feedback response upon a condition being met. FIG. 15 illustrates a vibrating element 40 being connected within a first connector 20. FIG. 16 illustrate a vibrating element 40 being connected within a second connector 50. Although not shown, it should be appreciated that in some embodiments both the first and second connectors 20, 50 may each include its own vibrating element 40.

The conditions necessary for activation of the vibrating element 40 may also vary in different embodiments. In a first embodiment, the vibrating element 40 may only activate upon an electrical and/or magnetic connection being completed between the first and second connectors 20, 50. In another embodiment, the vibrating element 40 may only activate upon an electrical and/or magnetic connection being disconnected between the first and second connectors 20, 50. In some embodiments, the vibrating element 40 may activate once upon an electrical connection being completed and once upon the electrical connection being disconnected.

The type of haptic feedback response may also vary in different embodiments and should not be construed as limited to any particular example described or shown herein. For example, the intensity of the haptic feedback response may vary in different embodiments for different types of connectors 20, 50. The haptic feedback response may only vibrate a small portion of the connector 20, 50, or may vibrate intensely to vibrate the entire connector 20, 50.

Similarly, the duration of vibration may vary in different embodiments, as well as the period of vibration. The vibration may be comprised of quick pulses or may be comprised of a longer duration vibration. For example, the haptic feedback could comprise multiple pulses each having its own duration, such as ten one-second pulses. As another example, the haptic feedback could comprise a single, elongated pulse, such as a ten-second long single pulse. The speed of vibration may also vary between slower vibrations and faster vibrations.

Figure 17:
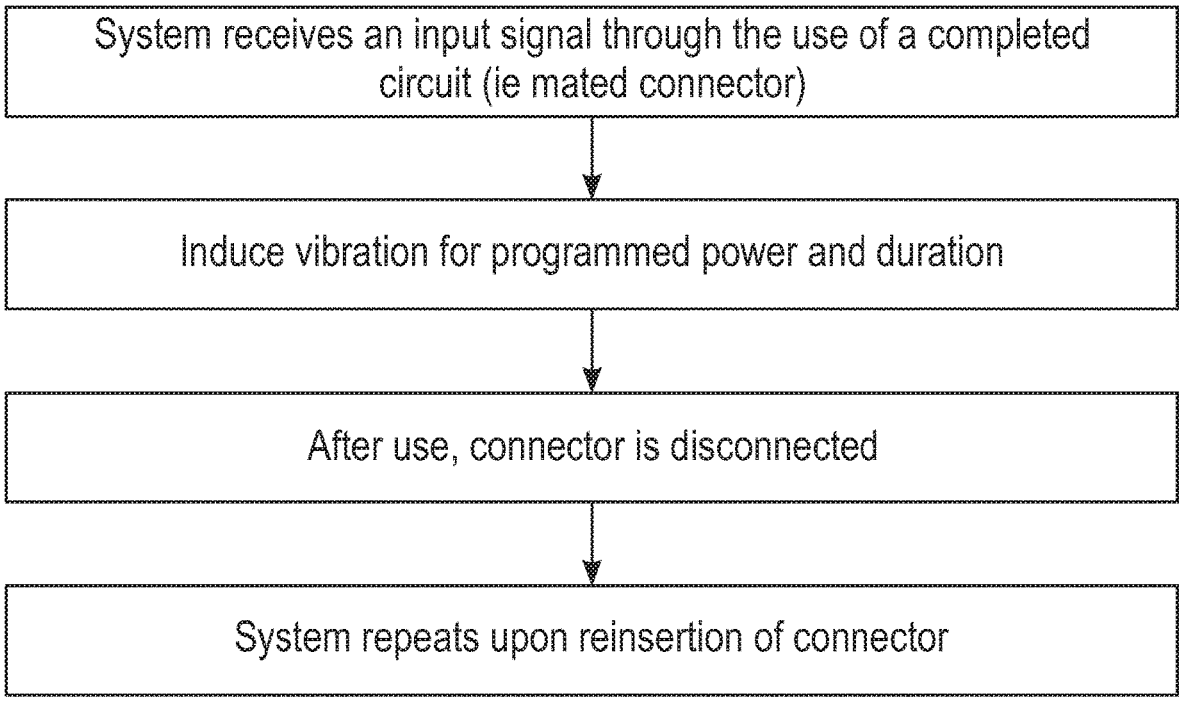
FIG. 17 is a flow chart illustrating haptic feedback response in a completed circuit of two mating connectors of a vibrating connector system in accordance with an example embodiment.

FIG. 17 illustrates a first method of providing a haptic feedback response upon electrical connection of a pair of connectors 20, 50. As shown, the system 10, upon receiving an input signal through completion of a circuit via mated connectors 20, 50 may induce vibration for a programmed power (intensity) and duration. Upon disconnection of the mated connectors 20, 50, the system 10 will remain idle until such time as the connectors 20, 50 are electrically mated again, at which time the haptic feedback response will again be provided.

Figure 18:
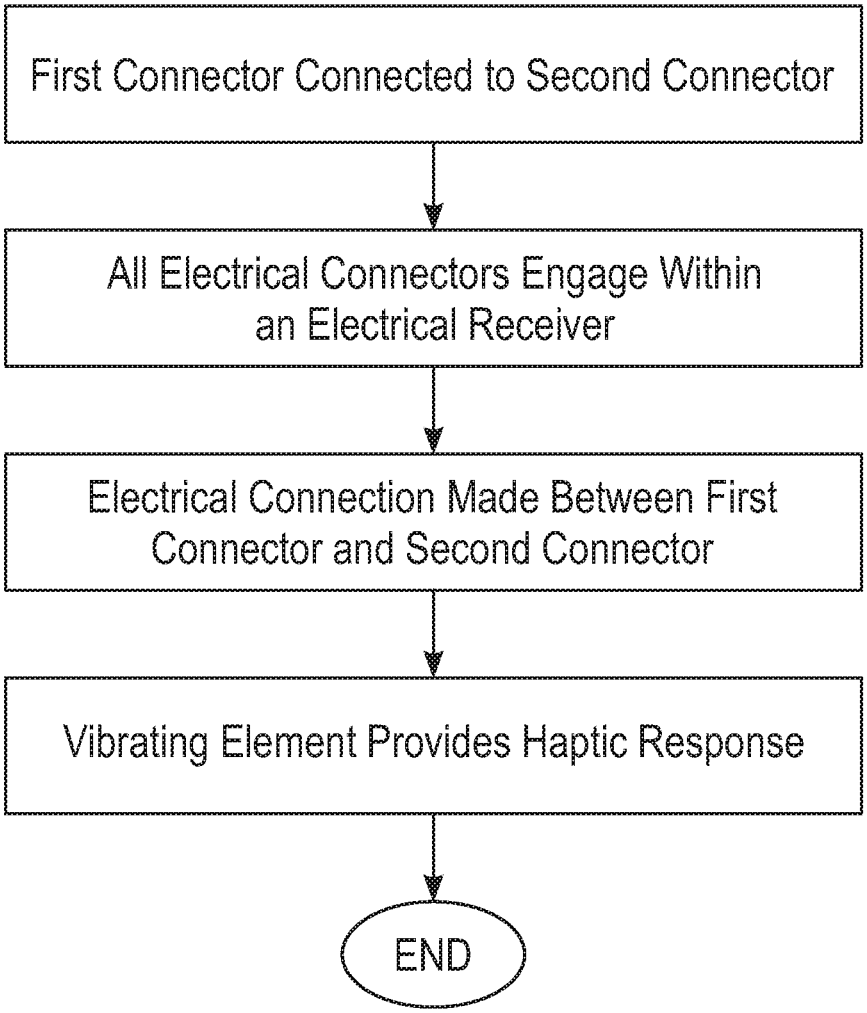
FIG. 18 is a flow chart illustrating a haptic feedback response being provided when an electrical connection is made between a first connector and a second connector of a vibrating connector system in accordance with an example embodiment.

FIG. 18 illustrates another method of providing a haptic feedback response upon electrical connection of a pair of connectors 20, 50. As shown, the first connector 20 may first be connected to the second connector 50 by engaging the respective couplers 24, 54. When all electrical connectors 35 are engaged within a corresponding electrical receiver 65, an electric connection is made between the first and second connectors 20, 50. The vibrating element 40 will then activate for a set duration and intensity to provide the haptic feedback response indicating an electrical connection being completed between the first and second connectors 20, 50.

Figure 19:
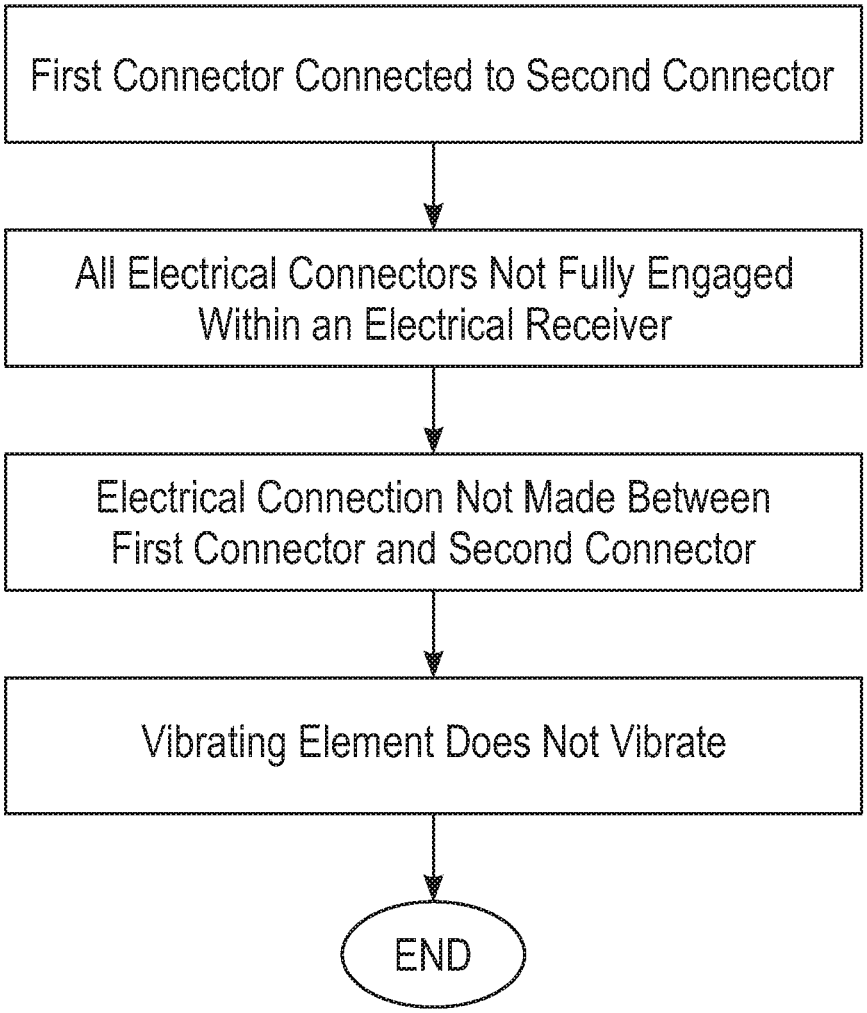
FIG. 19 is a flow chart illustrating no response being provided when an electrical connection is not made between a first connector and a second connector of a vibrating connector system in accordance with an example embodiment.

FIG. 19 illustrates a method of preventing a false positive in which the vibrating element 40 remains idle until an electrical connection (rather than a mere mechanical connection) is completed between the connectors 20, 50. As shown, the first connector 20 is first connected to the second connector 50, with the couplers 24, 54 being mechanically engaged but the electrical connectors 35 not being fully engaged with the electrical receivers 65. In such a situation, an electrical connection is not made between the first and second connectors 20, 50, and thus the vibrating element 40 does not vibrate.

Figure 20:
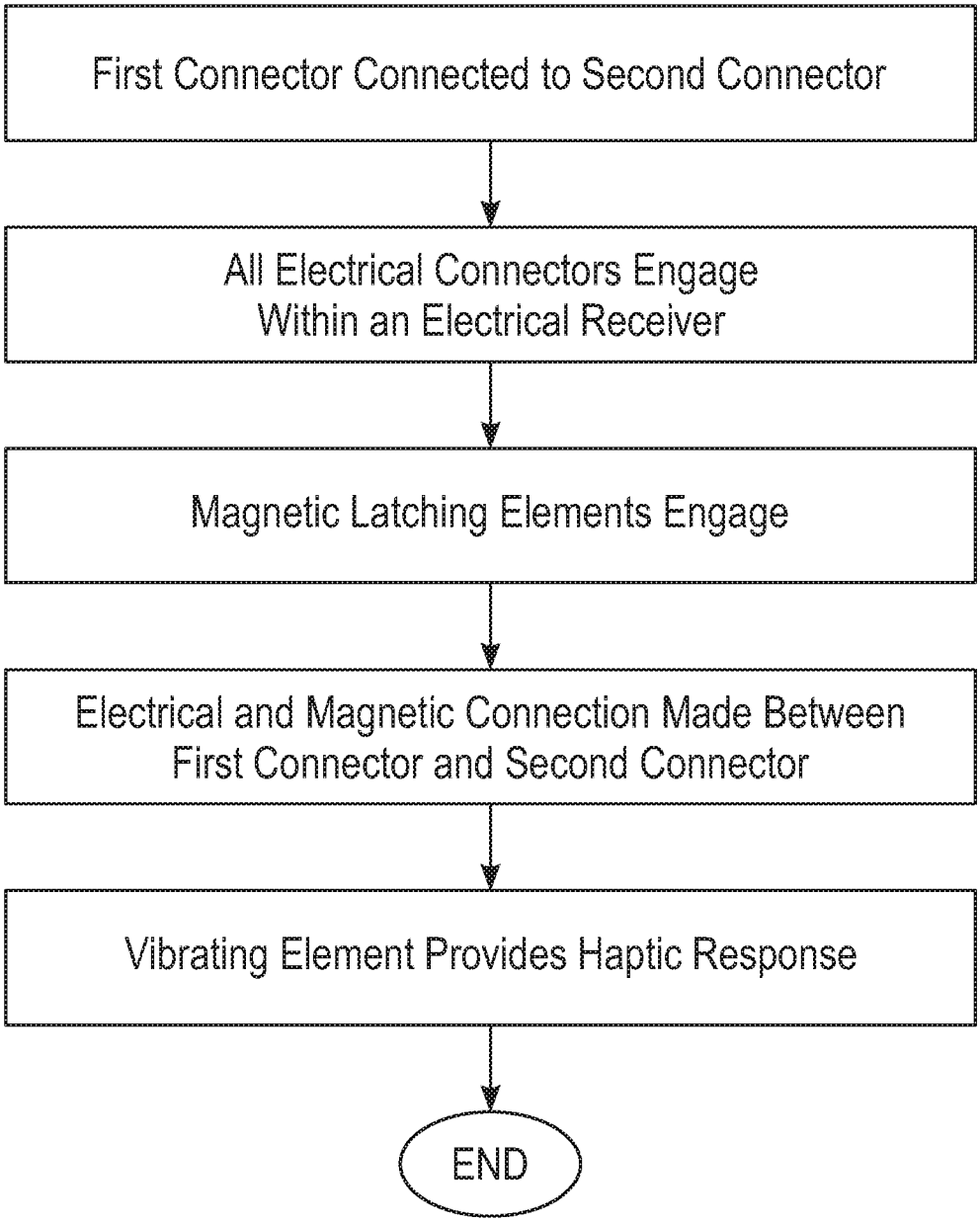
FIG. 20 is a flowchart illustrating a haptic feedback response being provided when an electrical and magnetic connection is made between a first connector and a second connector of a vibrating connector system in accordance with an example embodiment.

FIG. 20 illustrates a method of providing a haptic feedback response upon both a magnetic and electrical connection being completed. Many connectors 20, 50 may include a magnetic latching element 38, 68 to ensure a firm, mated connection between the connectors 20, 50. One such type of magnetic connector configuration is shown and described in U.S. Pat. No. 9,985,384, issued on May 29, 2018 for a "Magnetic Latching Connector", which is hereby incorporated by reference herein. Continuing to reference FIG. 20, upon the magnetic latching elements 38, 68 being engaged and all electrical connectors 35 being engaged with an electrical receiver 65, both an electrical and magnetic connection will have been made between the first and second connectors 20, 50. The vibrating element 40 will then activate to provide the haptic feedback response.

It should be appreciated that the configuration of the connectors 20, 50 may vary in different embodiments. In some embodiments, both the first and second connectors 20, 50 may each be connected to a distal end of a cable 15. Such embodiments may be utilized to connect a pair of cables 15 together, such as is common with extension cords and the like. In such embodiments, the vibrating element 40 may vibrate upon electrical connection, electrical disconnection, electrical connection failure, magnetic connection, magnetic disconnection, or any combination thereof.

In other embodiments, the first connector 20 or the second connector 50 may be connected to a component 18 such as described previously, with the other connector 20, 50 being connected to a cable 15 adapted to connect to the component 18. Such a configuration is common with devices in the modern age, in which various peripherals or power supplies may be connected to such devices. A ubiquitous example is the charging of a mobile phone, in which the mobile phone is the component 18 to which a cable 15 is connected for transfer of electrical power or signals. Another example is a computer (desktop, tablet, or laptop) in which the computer serves as the component 18 and the cable 15 is connected to the computer for transfer of electrical power or signals, such as a power cable or peripheral cable.

Although not shown, the vibrating connector system 10 may be utilized with connection hubs such as three-way connectors and the like. By way of example, a power splitter comprised of multiple female couplers 54 may be adapted to receive a plurality of cables 15, with each of the cables 15 including a first connector 20 having a vibrating element 40 to indicate when each cable 15 is properly connected to the power splitter.

Unless otherwise defined, all technical and scientific terms used herein have the same meaning as commonly understood by one of ordinary skill in the art to which this invention belongs. Although methods and materials similar to or equivalent to those described herein can be used in the practice or testing of the vibrating connector system, suitable methods and materials are described above. All publications, patent applications, patents, and other references mentioned herein are incorporated by reference in their entirety to the extent allowed by applicable law and regulations. The vibrating connector system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A vibrating connector system, comprising:

a first connector comprising a front end and a rear end, wherein the first connector comprises a plurality of first electrically conductive elements at or near the front end of the first connector;

an electrical conduit connected to the first connector;

a second connector comprising a front end and a rear end, wherein the second connector comprises a plurality of second electrically conductive elements at or near the front end of the second connector;

wherein the first connector and the second connector are adapted to be coupled together such that the plurality of first electrically conductive elements of the first connector electrically connect to the plurality of second electrically conductive elements of the second connector; and a vibrating motor electrically connected between the electrical conduit and the plurality of first electrically conductive elements of the first connector such that an electrical current is applied to the vibrating motor only when the plurality of first electrically conductive elements of the first connector are electrically connected to the plurality of second electrically conductive elements of the second connector, wherein the vibrating motor is adapted to vibrate only when the plurality of first electrically conductive elements of the first connector are electrically connected to the plurality of second electrically conductive elements of the second connector, wherein the vibrating motor is comprised of a rotating disk motor, and wherein the rotating disk motor is comprised of a rotating disk and an electrical motor to rotate the disk.

2. The vibrating connector system of claim 1, wherein the plurality of first electrically conductive elements and the plurality of second electrically conductive elements are comprised of pins or sockets.

3. The vibrating connector system of claim 1, wherein the plurality of first electrically conductive elements are comprised of sockets and wherein the plurality of second electrically conductive elements are comprised of pins.

4. The vibrating connector system of claim 1, wherein the plurality of first electrically conductive elements are comprised of pins and wherein the plurality of second electrically conductive elements are comprised of sockets.

5. The vibrating connector system of claim 1, wherein the vibrating motor is directly connected to at least one of the plurality of first electrically conductive elements.

6. The vibrating connector system of claim 1, wherein the vibrating motor is directly connected to the electrical conduit.

7. The vibrating connector system of claim 1, wherein the first connector is connected to a cable and the second connector is connected to an electrical device.

8. The vibrating connector system of claim 1, wherein the first connector comprises a housing, wherein the vibrating motor is positioned within the housing of the first connector.

9. The vibrating connector system of claim 8, wherein the housing of the first connector comprises a recessed opening, wherein the plurality of first electrically conductive elements is positioned within the recessed opening, wherein the plurality of first electrically conductive elements is oriented towards the front end of the first connector.

10. The vibrating connector system of claim 1, wherein the first connector is comprised of a male coupler and the second connector is comprised of a female coupler.

11. The vibrating connector system of claim 1, wherein the first connector is comprised of a female coupler and the second connector is comprised of a male coupler.

12. The vibrating connector system of claim 1, comprising a control unit operatively connected to the vibrating motor.

13. The vibrating connector system of claim 12, wherein the vibrating motor is adapted to vibrate for a preset duration when the first connector is electrically connected to the second connector.

14. The vibrating connector system of claim 12, wherein the vibrating motor is adapted to pulse when the first connector is electrically connected to the second connector.

15. The vibrating connector system of claim 1, wherein the first connector comprises a first magnetic latching element and wherein the second connector comprises a second magnetic latching element, wherein the first magnetic latching element is adapted to magnetically engage with the second magnetic latching element when the first connector is connected to the second connector.

16. The vibrating connector system of claim 1, wherein the first connector is connected to a cable and wherein the second connector is connected to a wall.

17. A vibrating connector system, comprising:

a first connector comprising a housing, front end and a rear end, wherein the first connector comprises a plurality of first electrically conductive elements at or near the front end of the first connector, wherein the first connector comprises a male coupler;

an electrical conduit connected to the first connector;

a second connector comprising a front end and a rear end, wherein the second connector comprises a plurality of second electrically conductive elements at or near the front end of the second connector, wherein the second connector comprises a female coupler;

wherein the male coupler of the first connector and the female coupler of the second connector are adapted to be coupled together such that the plurality of first electrically conductive elements of the first connector electrically connect to the plurality of second electrically conductive elements of the second connector; and a vibrating motor comprised of a rotating disk motor electrically connected between the electrical conduit and the plurality of first electrically conductive elements of the first connector such that an electrical current is applied to the vibrating motor only when the plurality of first electrically conductive elements of the first connector are electrically connected to the plurality of second electrically conductive elements of the second connector, wherein the vibrating motor is positioned within the housing, wherein the vibrating motor is adapted to vibrate only when the plurality of first electrically conductive elements of the first connector are electrically connected to the plurality of second electrically conductive elements of the second connector, wherein the rotating disk motor is comprised of a rotating disk and an electrical motor connected to the rotating disk to rotate the disk, and wherein the vibrating motor is directly connected to both the electrical conduit and the plurality of first electrically conductive elements of the first connector.

* * * * *